US010838345B2

(12) United States Patent
Anzai

(10) Patent No.: US 10,838,345 B2
(45) Date of Patent: Nov. 17, 2020

(54) IMAGE FORMING APPARATUS

(71) Applicant: Oki Data Corporation, Tokyo (JP)

(72) Inventor: Kae Anzai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 85 days.

(21) Appl. No.: 16/105,067

(22) Filed: Aug. 20, 2018

(65) Prior Publication Data

US 2019/0086854 A1 Mar. 21, 2019

(30) Foreign Application Priority Data

Sep. 15, 2017 (JP) ..... 2017-177945
May 16, 2018 (JP) ..... 2018-094417

(51) Int. Cl.

| | |
|---|---|
| ***G03G 15/00*** | (2006.01) |
| ***B65H 35/06*** | (2006.01) |
| ***B65H 43/00*** | (2006.01) |
| ***B65H 23/26*** | (2006.01) |
| ***B65H 23/16*** | (2006.01) |

(Continued)

(52) U.S. Cl.

CPC ..... *G03G 15/6523* (2013.01); *B65H 23/042* (2013.01); *B65H 23/16* (2013.01); *B65H 23/26* (2013.01); *B65H 26/063* (2013.01); *B65H 35/002* (2013.01); *B65H 35/06* (2013.01); *B65H 43/00* (2013.01); *B65H 2301/121* (2013.01); *B65H 2301/4491* (2013.01); *B65H 2553/412* (2013.01); *B65H 2701/194* (2013.01); *B65H 2801/12* (2013.01); *G03G 15/6517* (2013.01)

(58) Field of Classification Search

CPC ..... G03G 15/6523; G03G 15/5029; G03G 15/161; G03G 15/652; G03G 15/0216; G03G 15/6567; G03G 15/162; G03G 2215/1685; G65H 23/26; B65H 43/00; B65H 35/06; B65H 23/16; B41L 13/06; B41L 29/16; B41L 29/12; B41C 1/144; B41J 15/046; B41J 15/165

USPC ..... 83/76.7, 75, 78, 522.27; 101/128.4, 116, 101/115, 228, 122, 128.21, 477, 117, 114, 101/121, 126, 129, 118, 28.1, 119; 347/218, 220, 2, 219, 262, 264, 104, 566; 346/134

See application file for complete search history.

(56) References Cited

U.S. PATENT DOCUMENTS 3,495,782 A * 2/1970 Mikolyczyk ..... B23D 36/00 242/523.1
5,487,333 A * 1/1996 Oshio ..... B41L 31/00 101/116

(Continued)

FOREIGN PATENT DOCUMENTS

JP 2004-217356 A 8/2004

*Primary Examiner* — Ghassem Alie
(74) *Attorney, Agent, or Firm* — Muncy, Geissler, Olds & Lowe, P.C.

(57) ABSTRACT

An image forming apparatus, includes (1) a medium holding unit that holds a recording medium; (2) a guide member configured to be movable, that sets a medium path of the recording medium fed from the medium holding unit as a predetermined path by being locked in a predetermined position, and that is unlocked by a tension of the recording medium; (3) a first conveyance member that is arranged downstream of the medium path of the guide member, and conveys the recording medium; and (4) an image forming unit that forms an image to the recording medium conveyed by the first conveyance member.

12 Claims, 19 Drawing Sheets

(51) Int. Cl.

| | |
|---|---|
| ***B65H 26/06*** | (2006.01) |
| ***B65H 23/04*** | (2006.01) |
| ***B65H 35/00*** | (2006.01) |

(56) References Cited

U.S. PATENT DOCUMENTS

| | | | | |
|---|---|---|---|---|
| 6,595,127 | B2 * | 7/2003 | Ono | B41L 13/06<br>101/116 |
| 2011/0063391 | A1 * | 3/2011 | Miyamoto | B41J 15/046<br>347/104 |

* cited by examiner

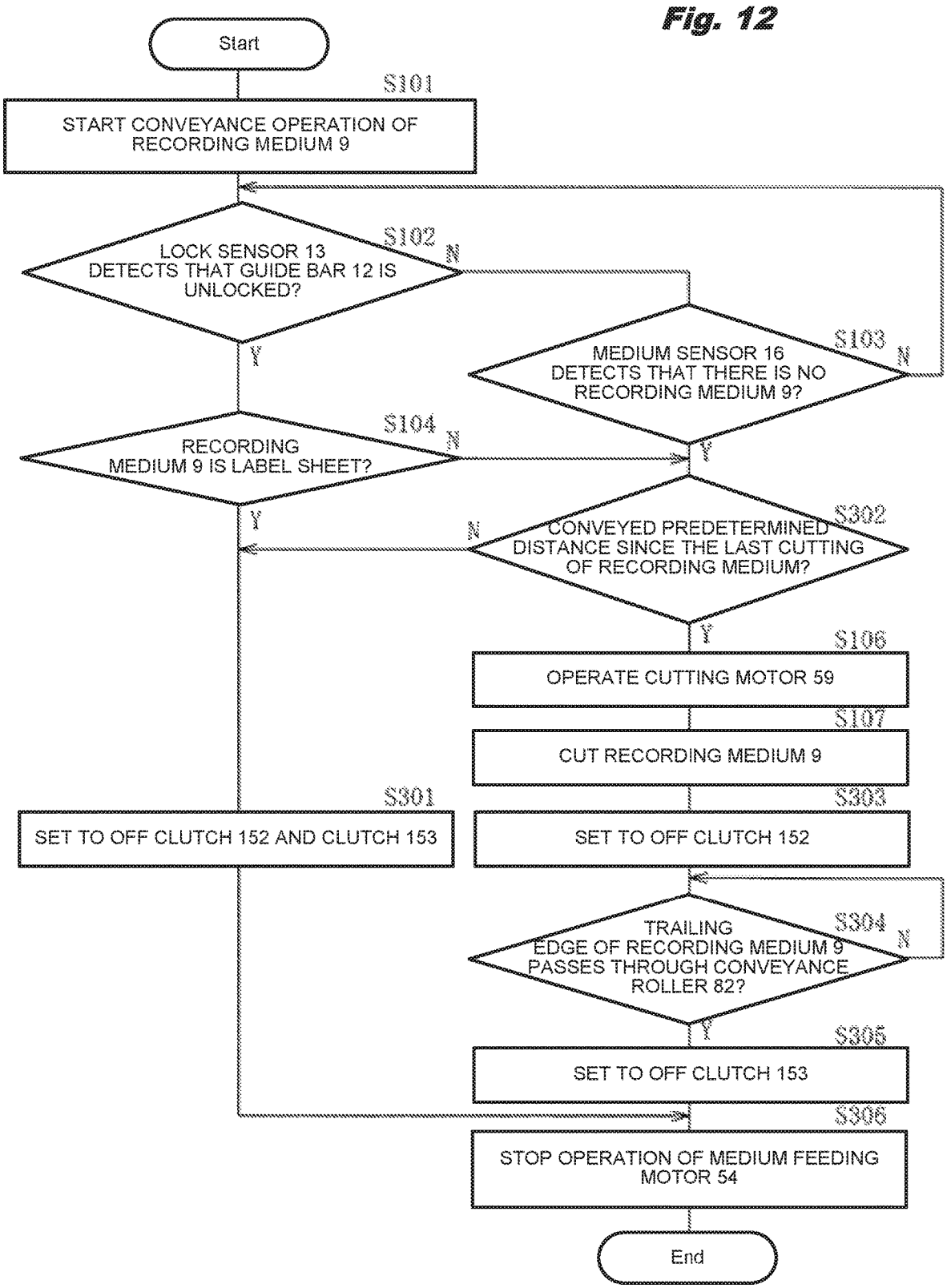
Fig. 12
Start
S101
START CONVEYANCE OPERATION OF RECORDING MEDIUM 9
S102
LOCK SENSOR 13 DETECTS THAT GUIDE BAR 12 IS UNLOCKED?
N
Y
S103
MEDIUM SENSOR 16 DETECTS THAT THERE IS NO RECORDING MEDIUM 9?
N
Y
S104
RECORDING MEDIUM 9 IS LABEL SHEET?
N
Y
S302
CONVEYED PREDETERMINED DISTANCE SINCE THE LAST CUTTING OF RECORDING MEDIUM?
N
Y
S106
OPERATE CUTTING MOTOR 59
S107
CUT RECORDING MEDIUM 9
S301
SET TO OFF CLUTCH 152 AND CLUTCH 153
S303
SET TO OFF CLUTCH 152
S304
TRAILING EDGE OF RECORDING MEDIUM 9 PASSES THROUGH CONVEYANCE ROLLER 82?
N
Y
S305
SET TO OFF CLUTCH 153
S306
STOP OPERATION OF MEDIUM FEEDING MOTOR 54
End

IMAGE FORMING APPARATUS

CROSS REFERENCE TO RELATED APPLICATIONS

This application claims priority under 35 USC 119 to Japanese Patent Applications No. 2017-177945 filed on Sep. 15, 2017, and No. 2018-094417 filed on May 16, 2018, the entire contents which are incorporated herein by reference.

TECHNICAL FIELD

The present invention relates to an image forming apparatus that forms an image.

BACKGROUND ART

An image forming apparatus is capable of forming an image on an elongated recording medium such as roll paper. For example, according to Japanese Patent Application Laid-Open (JP-A) No. 2004-217356, the image forming apparatus that detects a trailing edge of roll paper is disclosed.

By the way, in the image forming apparatus, it is desired to be effectively available without wasting a recording medium.

SUMMARY OF THE INVENTION

The invention relates to an image forming apparatus, which includes (1) a medium holding unit that holds a recording medium; (2) a guide member configured to be movable, that sets a medium path of the recording medium fed from the medium holding unit as a predetermined path by being locked in a predetermined position, and that is unlocked by a tension of the recording medium; (3) a first conveyance member that is arranged downstream of the medium path of the guide member, and conveys the recording medium; and (4) an image forming unit that forms an image to the recording medium conveyed by the first conveyance member.

BRIEF DESCRIPTION OF THE DRAWINGS

FIG. 12 is a flowchart illustrating an example operation performed by the image forming apparatus illustrated FIG. 10.

DESCRIPTION OF THE EMBODIMENTS

Hereinafter, embodiments of the present invention will be described in detail with reference to the drawings.

(1) First Embodiment

Figure 1:
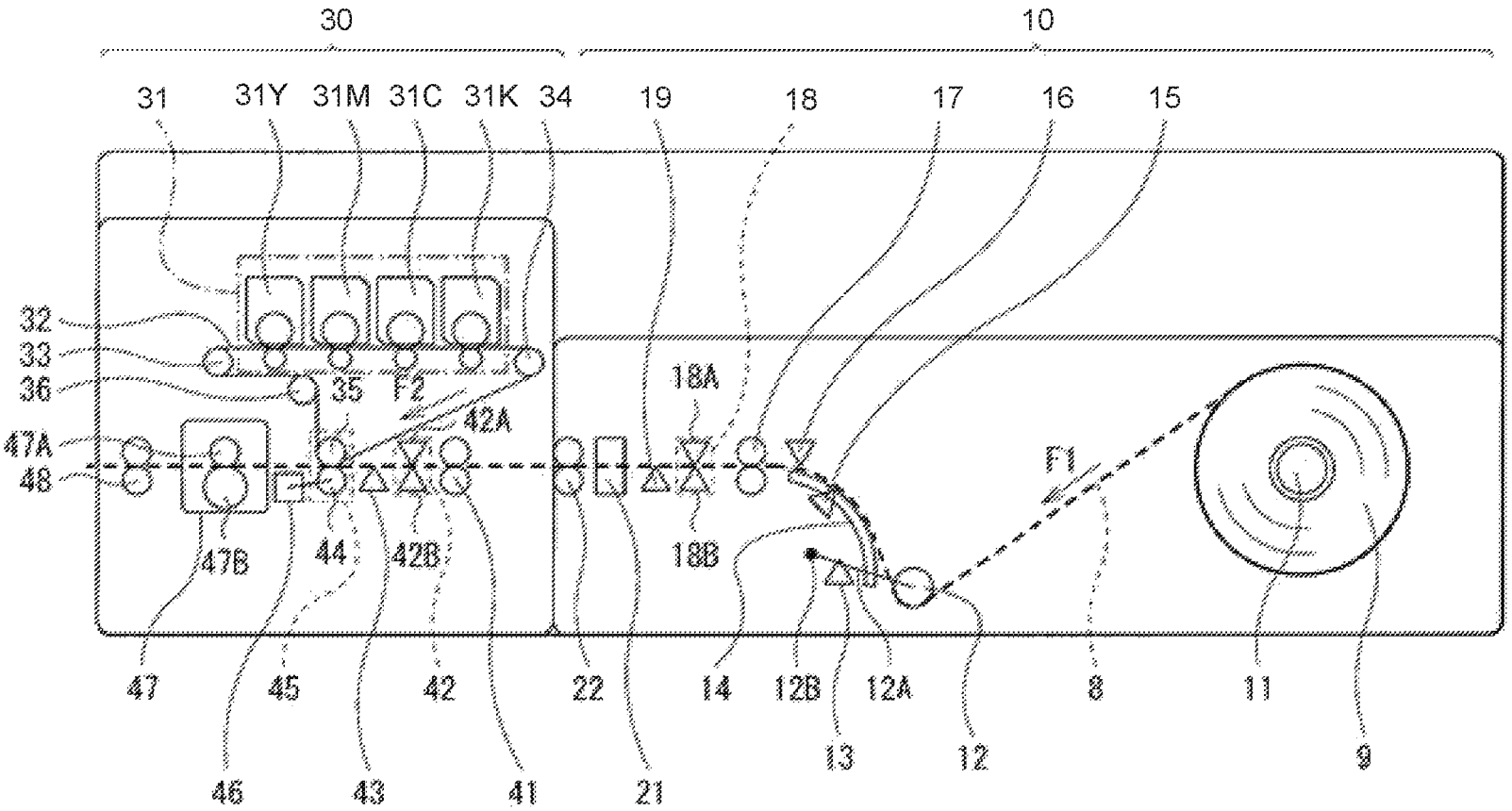
FIG. 1 is a configuration diagram illustrating an example configuration of an image forming apparatus according to an embodiment.

FIG. 1 illustrates an example configuration of an image forming apparatus 1 according to an embodiment of the present invention. For example, the image forming apparatus 1 is a printer that forms an image by using an electrophotographic method to a recording medium as roll paper.

The image forming apparatus 1 includes a medium feeding unit 10 and an image forming unit 30.

The medium feeding unit 10 pulls a recording medium 9 out from a roll rolled the recording medium 9 and feeds the recording medium 9 to the image forming unit 30. The medium feeding unit 10 includes a medium holder 11, a guide bar 12, a lock sensor 13, a medium guide 14, a medium placement sensor 15, a medium sensor 16, a medium feeding roller 17, a cutter-in-transmission sensor 18, a cutter-in-reflection sensor 19, a cutting unit 21, a conveyance roller 22. The guide bar 12, the lock sensor 13, the medium placement sensor 15, the medium sensor 16, the medium feeding roller 17, the cutter-in-transmission sensor 18, the cutter-in-reflection sensor 19, the cutting unit 21 and the conveyance roller 22 are arranged in this order along a conveyance path 8.

The medium holder 11 holds rotatably the rolled recording medium 9. For example, the recording medium 9 can use a label sheet 9A or a continuous sheet 9B.

Figure 2A:
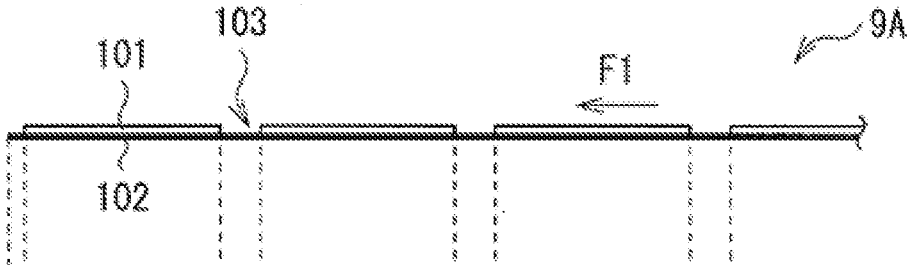
FIG. 2A is an explanatory diagram illustrating a side view of a label sheet.
Figure 2B:
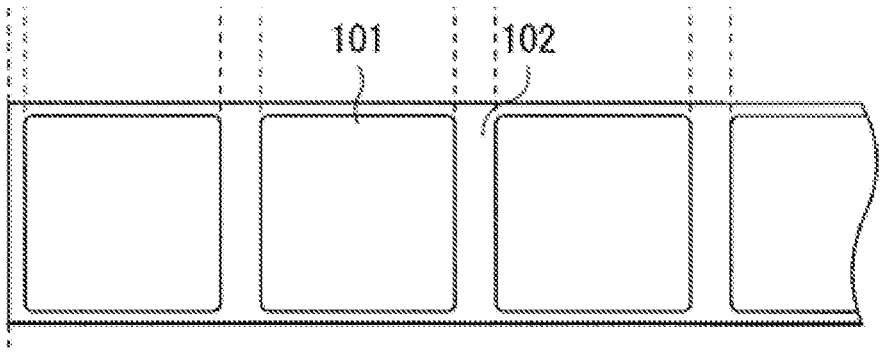
FIG. 2B is an explanatory diagram illustrating a front surface of the label sheet.
Figure 2C:
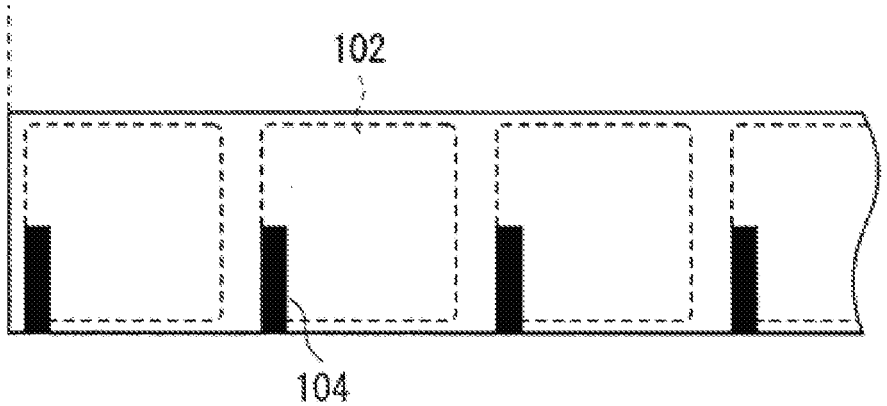
FIG. 2C is an explanatory diagram illustrating a back surface of the label sheet.

FIG. 2A to FIG. 2C illustrate an example of the label sheet 9A. FIG. 2A illustrates a side view of the label sheet 9A. FIG. 2B illustrates a front surface of the label sheet 9A. FIG. 2C illustrates a back surface of the label sheet 9A. The label sheet 9A includes a plurality of labels 101 and a base sheet 102. Each label 101 can be peeled from the base sheet 102 and pasted on various things, after the image is formed by the image forming unit 30. The plurality of labels 101 are arranged side by side across a gap 103 in a longitudinal direction of the label sheet 9A, and temporarily attached to the base sheet 102. As illustrated in FIG. 2C, the base sheet 102 is printed with black marks 104 on the opposite surface (a back surface) of temporarily attached surface the plurality of labels 101. Each black mark 104 is printed at a position coinciding with the leading edge of a corresponding one of labels 101 in the case of the label sheet 9A is conveyed in the conveyance direction F1.

In this example, the label sheet 9A may be formed by using the base sheet 102 printed with black marks 104, the invention is not limited to this. Instead, the label sheet may be formed by using the base sheet on which the black marks are not printed.

Figure 3:
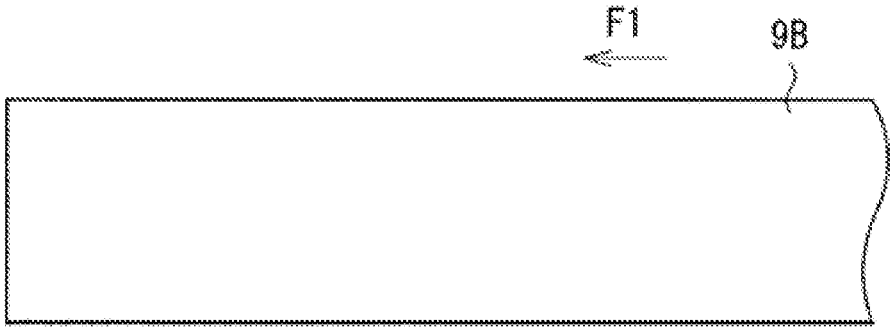
FIG. 3 is an explanatory diagram illustrating another example configuration of a recording medium illustrated FIG. 1.

FIG. 3 illustrates an example of the continuous sheet 9B. The continuous sheet 9B is elongated plain paper, and the image can be continuously formed by the image forming unit 30.

In this example, the roll of the recording medium 9 is formed by rolling the recording medium 9 around a core 110. As described below, a trailing edge of the recording medium 9 may be fixed to the core 110 or may not be fixed to the core 110.

FIG. 4A to FIG. 4D illustrate relevance between the trailing edge of the recording medium 9 and the core 110. In an example of FIG. 4A, the trailing edge of the recording medium 9 is fixed to the core 110 by coating glue to a wide area (shaded area 111) throughout the width direction of the recording medium 9. In an example of FIG. 4B, the trailing edge of the recording medium 9 is simply fixed to the core 110 by coating glue to a narrow area (shaded area 112) near a center in the width direction of the recording medium 9. In an example of FIG. 4C, the trailing edge of the recording medium 9 is simply fixed to the core 110 by using a tape 113, near a center of the width direction of the recording medium 9. In an example of FIG. 4D, the trailing edge of the recording medium 9 is not fixed to the core 110.

The medium holder 11 is placed various recording medium 9 as described above. Clockwise force is generated in the medium holder 11 in FIG. 4A to FIG. 4D based on driving power transmitted from a medium holder motor 53 (see FIG. 5). Hence, the recording medium 9 does not slack in the medium feeding unit 10.

The guide bar 12 is a member guiding the recording medium 9. The guide bar 12 is movable in a vertical direction in FIG. 1, and can change a path of the conveyance path 8 of the recording medium 9 in accordance with a position of the guide bar 12. The guide bar 12 includes an arm 12A. The arm 12A rotates around an axis 12B. Hence, the guide bar 12 is movable in the vertical direction by the arm 12A rotating around the axis 12B. Specifically, for example, if the recording medium 9 is placed in the medium feeding unit 10, the guide bar 12 is locked by an unillustrated lock mechanism at a position to detour the conveyance path 8 as illustrated in FIG. 1. As described below, if a lock of the guide bar 12 is unlocked by a load change (a tension change of the recording medium 9) when conveying the recording medium 9, the guide bar 12 moves in the vertical direction.

The lock sensor 13 detects whether the guide bar 12 is locked. Specifically, the lock sensor 13 detects whether the guide bar 12 is locked by detecting the arm 12A of the guide bar 12.

The medium guide 14 is a member that guides the recording medium 9. In this example, the medium guide 14 is an arc shape. The guide bar 12 holds down the recording medium 9 to a protruding surface of the medium guide 14 of the arc shape if the guide bar 12 is locked at the position illustrated in FIG. 1. Hence, the medium guide 14 guides the recording medium 9 along the protruding surface of the medium guide 14.

The medium placement sensor 15 detects whether the recording medium 9 is placed along the medium guide 14.

The medium sensor 16 detects whether the recording medium 9 is placed in the medium feeding unit 10.

The medium feeding roller 17 is a member formed by a pair of roller across the conveyance path, and conveys the recording medium 9 along the conveyance path 8 based on driving power transmitted from the medium feeding motor 54.

The cutter-in-transmission sensor 18 is an optical sensor that specifies a cutting position for the cutting unit 21 if the recording medium 9 is the label sheet 9A. The cutter-in-transmission sensor 18 includes a light emitter 18A and a light receiver 18B. The light emitter 18A emits light and the light receiver 18B receives light. The light emitter 18A and the light receiver 18B are arranged on the opposite side across the conveyance path 8. In the cutter-in-transmission sensor 18, light emitted from the light emitter 18A transmits through the recording medium 9, and is received by the light receiver 18B. If the recording medium 9 is the label sheet 9A, the intensity of light received by the light receiver 18B changes in accordance with whether or not the label 101 in the recording medium 9 passing over between the light emitter 18A and the light receiver 18B. Hence, the cutter-in-transmission sensor 18 detects the gap 103 in the label sheet 9A, and can specify the cutting position based on detection result. As described above, the cutter-in-transmission sensor 18 can specify the cutting position by specifying the cutting position based on a light transmittance in recording medium 9, even if the case of using the label sheet on which black marks 104 are not printed.

The cutter-in reflection sensor 19 is an optical sensor that specifies the cutting position for the cutting unit 21 if the recording medium 9 is the label sheet 9A. The cutter-in-reflection sensor 19 includes a light emitter and a light receiver. The light emitter and the light receiver are arranged on the side of corresponding to a back surface of the recording medium 9 in the conveyance path 8. In the cutter-in-reflection sensor 19, light emitted from the light emitter is reflected, for example, by the back surface of the recording medium 9, and is received in the light receiver. If the recording medium 9 is the label sheet 9A printed with the black marks 104, the intensity of light received by the light receiver changes in accordance with whether or not the black marks 104 in the recording medium 9 passing over the cutter-in-reflection sensor 19. Hence, the cutter-in-reflection sensor 19 detects the gap 103 in the label sheet 9A, and can specify the cutting position based on detection result.

The cutter-in-transmission sensor 18 and the cutter-in-reflection sensor 19 are selected and used in accordance with a type of the recording medium 9.

The cutting unit 21 cuts the recording medium 9. In this example, the cutting unit 21 cuts the recording medium 9 by rotating a blade of a cutter based on driving power transmitted from a cutter motor 59.

The conveyance roller 22 is formed by a pair of roller across the conveyance path 8. The conveyance roller 22 conveys the recording medium 9 along the conveyance path 8 and feeds the recording medium 9 to the image forming unit 30, based on driving power transmitted from a conveyance motor 55.

The image forming unit 30 forms the image to the recording medium 9 fed from the medium feeding unit 10. The image forming unit 30 includes a developing unit 31, a transfer belt 32, a belt roller 33, a roller 34, a secondary transfer backup roller 35, a roller 36, a conveyance roller 41, a WR transmission sensor 42, a WR reflection sensor 43, a secondary transfer unit 45, a separating mechanism 46, a fixing unit 47, and an ejecting roller 48. The conveyance roller 41, the WR transmission sensor 42, the WR reflection sensor 43, the secondary transfer unit 45, the fixing unit 47, and the ejecting roller 48 are arranged in this order along the conveyance path 8.

The developing unit 31 forms a toner image of four colors. The developing unit 31 includes the developing unit of four colors (31Y, 31M, 31C, 31K). The developing unit 31Y forms a yellow toner image, the developing unit 31M forms a magenta toner image, the developing unit 31C forms a cyan toner image, and the developing unit 31K forms a black toner image. Further, the developing unit 31 transfers (primary transfer) the toner image of four colors onto a transfer surface of the transfer belt 32.

For example, the transfer belt 32 may be an endless elastic belt including an electrically-semiconductive plastic film having high resistance. The transfer belt 32 may lie on the belt roller 33, the roller 34, the secondary transfer backup roller 35, and the roller 36, while being stretched. Further, the transfer belt 32 may convey circularly in a conveyance direction F2 in accordance with rotation of the belt roller 33.

The belt roller 33 is a member that conveys circularly the transfer belt 32. In this example, the belt roller 33 may be arranged upstream of the four developing units 31Y, 31M 31C, 31K in the conveyance direction F2 in which the transfer belt 32 is to be conveyed. The belt roller 33 may rotate clockwise by driving power transmitted from a belt motor 57. Hence, the belt roller 33 conveys circularly the transfer belt 32 in the conveyance direction F2.

The roller 34 is a member that rotates in accordance with the circular conveyance of the transfer belt 32.

The secondary transfer backup roller 35 is a member that rotates in accordance with circular conveyance of the transfer belt 32. The secondary transfer backup roller 35 is arranged opposite a secondary transfer roller 44 across the conveyance path 8 and the transfer belt 32. The secondary transfer backup roller 35 forms the secondary transfer unit 45 with the secondary transfer roller 44. The secondary transfer backup roller 35 may be applied with transfer voltage VTR by a high voltage power supply 69. Thus, in the secondary transfer unit 45, a toner image onto the transfer surface of the transfer belt 32 transferred (primary transfer) by the developing unit 31 is transferred onto the recording medium 9 (secondary transfer).

The roller 36 is a member that rotates in accordance with the circular conveyance of the transfer belt 32.

The conveyance roller 41 is a member formed by a pair of roller across the conveyance path 8, and conveys the recording medium 9 fed from the medium feeding unit 10 towards the secondary transfer unit 45 along the conveyance path 8 based on driving power transmitted from the conveyance motor 55.

The WR transmission sensor 42 is an optical sensor that detects a position of the label 101 for adjusting a transfer position of the toner image by the secondary transfer unit 45 if the recording medium 9 is the label sheet 9A. The WR transmission sensor 42 includes a light emitter 42A and a light receiver 42B. The light emitter 42 and the light receiver 42B are arranged on the opposite sides across the conveyance path 8. In the WR transmission sensor 42, for example, light emitted from the light emitter 42A transmits through the recording medium 9 and is received by the light receiver 42B. Thus, the WR transmission sensor 42 can detect the position of the label 101 in the label sheet 9A. As described above, the WR transmission sensor 42 can detect the position of the label 101 in the label sheet 9A by detecting the position of the label 101 based on the light transmittance in recording medium 9, even so the case of using the label sheet on which black marks 104 are not printed.

The WR reflection sensor 43 is an optical sensor that detects the position of the label 101 for adjusting the transfer position of the toner image by the secondary transfer unit 45 if the recording medium 9 is the label sheet 9A. The WR reflection sensor 43 includes a light emitter and a light receiver. The light emitter and the light receiver are arranged on the side of corresponding to a back surface of the recording medium 9 in the conveyance path 8. In the WR reflection sensor 43, light emitted from the light emitter is reflected, for example, by the back surface of the recording medium 9, and is received by the light receiver. Thus, the WR reflection sensor 43 can detect the position of the label 101 in the label sheet 9A.

The WR transmission sensor 42 and the WR reflection sensor 43 are selected and used in accordance with the type of the recording medium 9 to be used.

The secondary transfer roller 44 is a member that transfers the toner image on the transfer surface of the transfer belt 32 to the recording medium 9. The secondary transfer roller 44 is arranged opposite the secondary transfer backup roller 35 across the conveyance path 8 and the transfer belt 32. The secondary transfer roller 44 forms the secondary transfer unit 45 with the secondary transfer backup roller 35.

The separating mechanism 46 separates the secondary transfer backup roller 35 and the secondary transfer roller 44 from each so as to be in a non-contact state. For example, when the recording medium 9 is cut by the cutting unit 21, there is a risk that at least a part of the toner image on the transfer surface of the transfer belt 32 extends beyond a trailing edge of the recording medium 9, i.e., extends beyond where the cut is made. In other words, when the trailing edge of the recording medium 9 moves beyond the secondary transfer unit 45 such that there is no recording medium 9 between the secondary transfer backup roller 35 and the secondary transfer roller 44, there can still be toner on the transfer belt 32. By separating the secondary transfer backup roller 35 from the secondary transfer roller 44, the transfer of the toner from the transfer belt 32 to the secondary transfer roller 44 is prevented. The separating mechanism 46 separates the secondary transfer backup roller 35 and the secondary transfer roller 44 from each other based on driving power transmitted from a separating motor 58.

The fixing unit 47 fixes the toner image transferred onto the recording medium 9 to the recording medium 9 by applying heat and pressure to the recording medium 9. The fixing unit 47 includes a heat roller 47A and a fixing belt 47B. For example, the heat roller 47A includes a heater such as a halogen lamp inside the heat roller 47A, applies heat to the toner on the recording medium 9. The fixing belt 47B is configured so that is formed a pressure contact unit between the heat roller 47A and the fixing belt 47B. Thus, in the fixing unit 47, the toner on the recording medium 9 is heated, melted, and applied with pressure. As a result, the toner image is fixed onto the recording medium 9.

The ejecting roller 48 includes a pair of rollers across the conveyance path 8. The ejecting roller 48 is a member that ejects the recording medium 9 to outside of the image forming apparatus 1 based on driving power transmitted from an ejecting motor 56.

Figure 5:
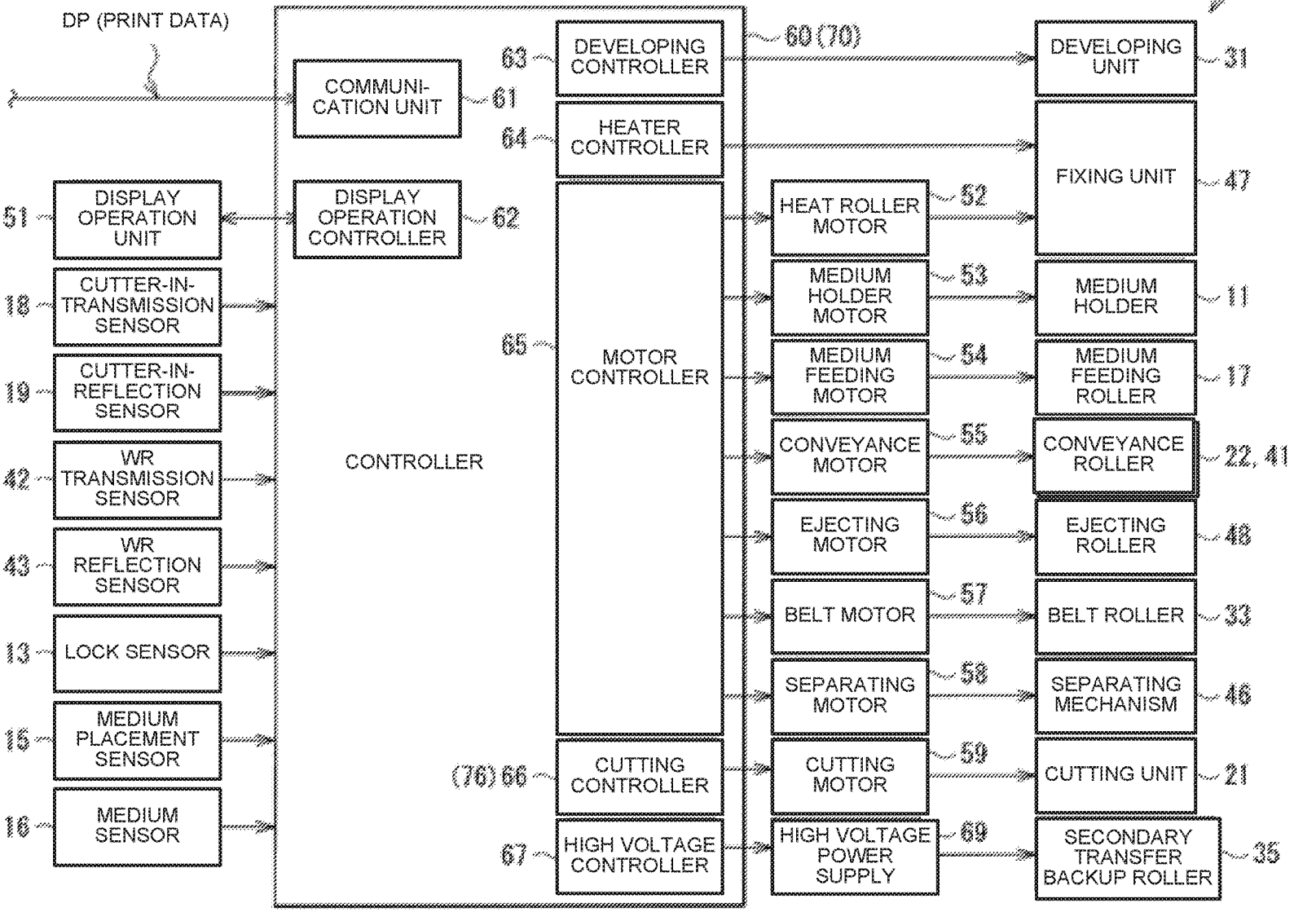
FIG. 5 is a block diagram illustrating an example configuration of a control mechanism of the image forming apparatus illustrated FIG. 1.

FIG. 5 illustrates an example of the controller mechanism in the image forming apparatus 1. The image forming apparatus 1 includes a display operation unit 51, a heat roller motor 52, the medium holder motor 53, the medium feeding motor 54, the conveyance motor 55, the ejecting motor 56, the belt motor 57, the separating motor 58, the cutting motor 59, the high voltage power supply 69, and a controller 60.

The display operation unit 51 receives an operation performed by a user and displays content such as an operation state of the image forming apparatus 1 or instructions to the user, and the like. For example, the display operation unit 51 includes components such as a liquid crystal display, a touch panel, various indicators, and various buttons.

The heat roller motor 52 supplies driving power to the heat roller 47A of the fixing unit 47 based on instructions from the controller 60. The medium holder motor 53 supplies driving power to the medium holder 11 based on instructions from the controller 60. The medium feeding motor 54 supplies driving power to the medium feeding roller 17 based on instructions from the controller 60. The conveyance motor 55 supplies driving power to the conveyance roller 22 and the conveyance roller 44 based on instructions from the controller 60. The ejecting motor 56 supplies driving power to the ejecting roller 48 based on instructions from the controller 60. The belt motor 57 supplies driving power to the belt roller 33 based on instructions from the controller 60. The separating motor 58 supplies driving power to the separating mechanism 46 based on instructions from the controller 60. The cutting motor 59 supplies driving power to the cutting unit 21 based on instructions from the controller 60. Although illustration is omitted, the image forming apparatus 1 includes a drum motor that supplies driving power to the developing unit 31.

The high voltage power supply 69 generates transfer voltage VTR based on instructions from the controller 60, and supplies transfer voltage VTR to the secondary transfer backup roller 35.

The controller 60 controls an overall operation of the image forming apparatus 1 by controlling an operation of each block in the image forming apparatus 1. For example, the controller 60 includes components such as a Central Processing Unit (CPU) and a memory, and the like. The controller 60 includes a communication unit 61, a display operation controller 62, a developing controller 63, a heater controller 64, a motor controller 65, a cutting controller 66, and a high voltage controller 67.

The communication unit 61 performs, for example, communication by using a universal serial bus (USB) or a local area network (LAN). For example, the communication unit 61 receives a print data DP transmitted from an unillustrated host computer. The display operation controller 62 controls an operation of the display operation unit 51. The developing controller 63 controls a developing operation in the developing unit 31. The heater controller 64 controls a temperature of the heat roller 47A by controlling an operation of the heater included the heat roller 47A of the fixing unit 47. The motor controller 65 controls an operation of the heat roller motor 52, the medium holder motor 53, the medium feeding motor 54, the conveyance motor 55, the ejecting motor 56, the belt motor 57, the separating motor 58, and the unillustrated drum motor.

The cutting controller 66 controls an operation of the cutting motor 59. Specifically, if the recording medium 9 is the label sheet 9A, the cutting controller 66 controls an operation of the cutting motor 59 so that the cutting unit 21 cuts the recording medium at a cutting position set to the gap 103 based on detection result of the cutter-in-transmission sensor 18 and/or the cutter-in-reflection sensor 19. As described later, the cutting controller 66 has a function that controls the operation of the cutting motor 59 so that the cutting unit 21 cuts the recording medium 9 based on detection result of the lock sensor 13 and the medium sensor 16.

The high voltage controller 67 controls an operation of the high voltage power supply 69.

In this example, the medium holder 11 corresponds to one specific example of "medium holder unit" in the present invention. The guide bar 12 corresponds to one specific example of "guide member" in the present invention. The lock sensor 13 corresponds to one specific example of "first sensor" in the present invention. The medium sensor 16 corresponds to one specific example of "second sensor" in present invention. The cutter-in-transmission sensor 18 and the cutter-in-reflection sensor 19 correspond to one specific example of "third sensor" in the present invention. The medium feeding roller 17 corresponds to one specific example of "first conveyance member" in the present invention. The cutting unit 21 corresponds to one specific example of "cutting unit" in the present invention. The image forming unit 30 corresponds to one specific example of "image forming unit" in the present invention. The conveyance roller 41 corresponds to one specific example of "second conveyance member" in the present invention.

Next, the operation and the function of the image forming apparatus of the present embodiment will be described.

First, with reference to FIG. 1 and FIG. 5, the summary of the overall operation of the image forming apparatus 1 will be described.

The controller 60 controls each block so that the image forming apparatus 1 performs the image forming operation, if the communication unit 61 receives the print data DP. The medium feeding roller 17, the conveyance roller 22, and conveyance roller 41 convey the recording medium 9 along the conveyance path 8. For example, if the recording medium 9 is a label sheet 9A, the cutting unit 21 cuts the recording medium 9 at cutting position set to the gap 103 based on detection result of the cutter-in-transmission sensor 18 and the cutter-in-reflection sensor 19. The belt roller 33 conveys circularly the transfer belt 32. The developing unit 31 forms the toner image of four colors, and the toner image of four colors formed transfers (primary transfer) onto the transfer surface of the transfer belt 32. The secondary transfer unit 45 transfers the toner image of the transfer surface of the transfer belt 32 to the recording medium 9. The fixing unit 47 is fixed the toner image on the recording medium 9. The ejecting roller 48 ejects the recording medium 9 to outside of the image forming apparatus 1.

Figure 4A:
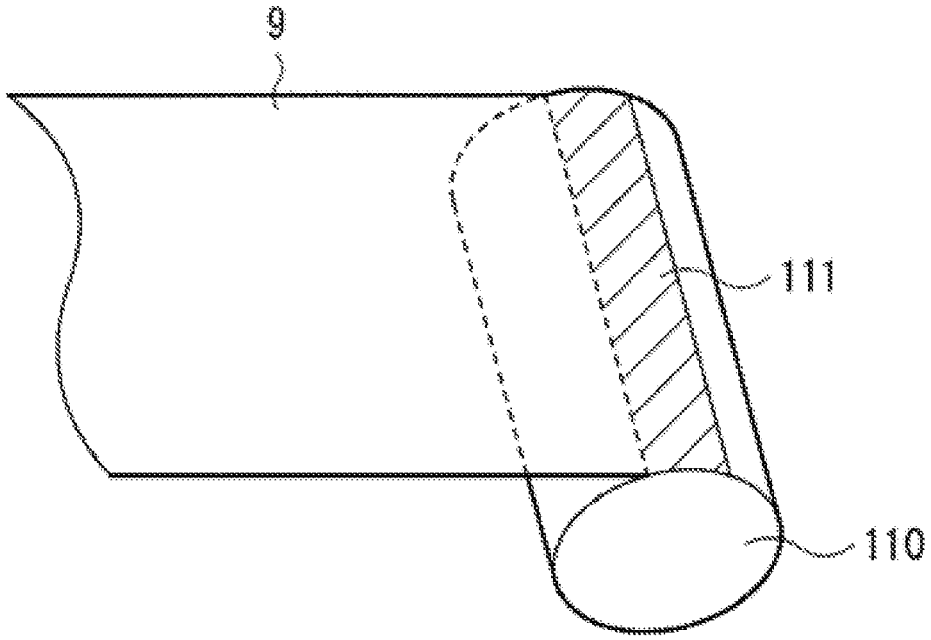
FIG. 4A is an explanatory diagram illustrating another example configuration of a recording medium illustrated FIG. 1.

In the image forming apparatus 1, in a case where the trailing edge of the recording medium 9 is fixed to the core 110 as illustrated in FIG. 4A, if the rest of the recording medium 9 has run out in the medium holder 11, the cutting unit 21 cuts the recording medium 9 based on the change of a load (the change of the tension of the recording medium 9) when conveying the recoding medium 9. In below, this operation will be described in detail.

Figure 6A:
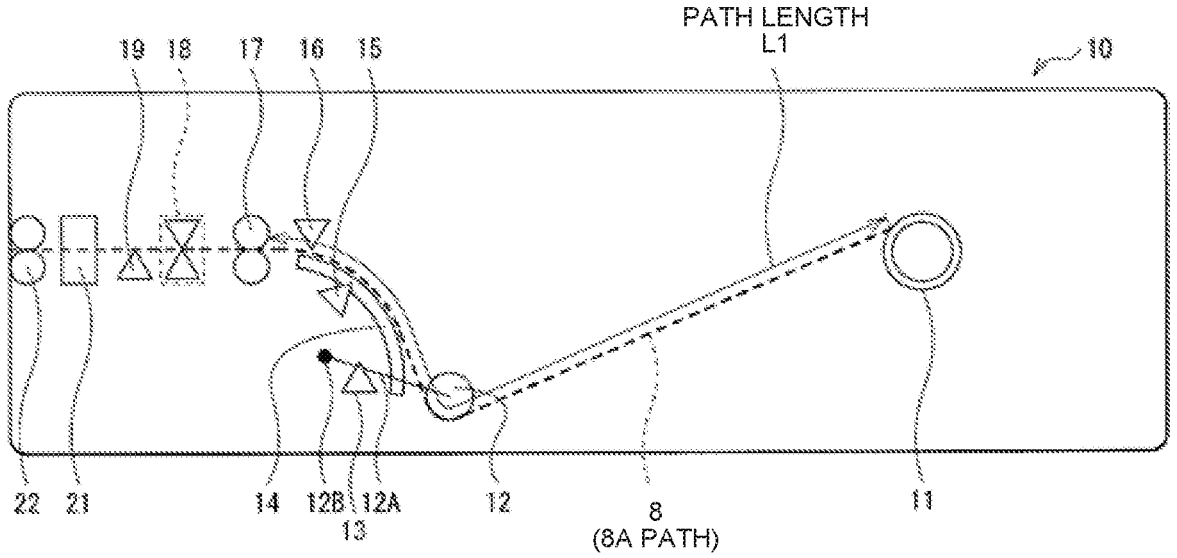
FIG. 6A is an explanatory illustrating an example operation performed by a medium feeding unit illustrated FIG. 1.
Figure 6B:
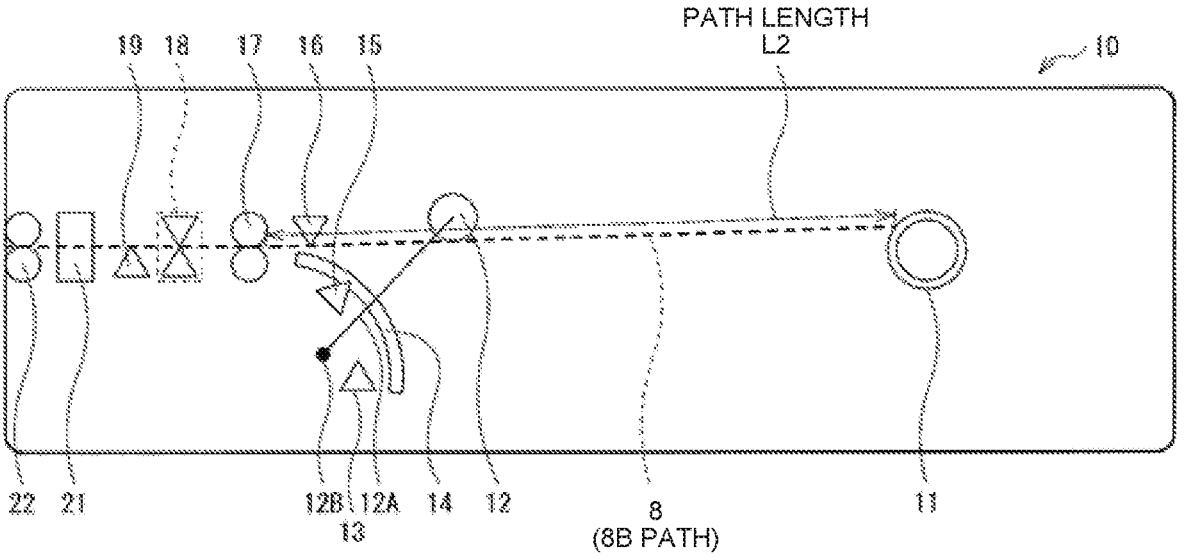
FIG. 6B is an explanatory illustrating another example operation performed by a medium feeding unit illustrated FIG. 1.
Figure 6C:
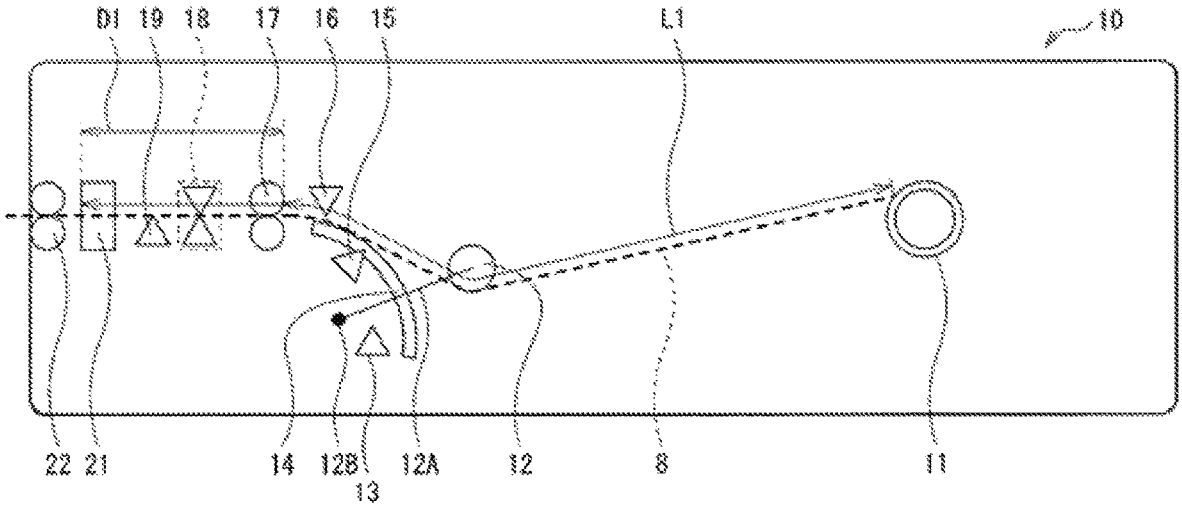
FIG. 6C is an explanatory illustrating another example operation performed by a medium feeding unit illustrated FIG. 1.

FIG. 6A illustrates an operation performed by the medium feeding unit 10 during normal operation, FIG. 6B illustrates an operation performed by the medium feeding unit 10 if the recording medium 9 has run out in the medium holder 11, and FIG. 6C illustrates an operation performed by the medium feeding unit 10 if the cutting unit 21 cuts the recording medium 9.

During normal operation, the guide bar 12 is locked by unillustrated lock mechanism at a position illustrated FIG. 6A. Thus, the conveyance path 8 is set to a path 8A of a path length L1 which is a little detour by the guide bar 12. The recording medium 9 is conveyed along the path 8A.

Further, if the recording medium 9 remained in the medium holder 11 gradually reduces and the rest of the recording medium has run out, the load when conveying the recording medium 9 seen from the guide bar 12 changes since the trailing edge of the recording medium 9 is fixed to the core 110. By the change of this load, a force is generated on the guide bar 12 toward the medium holder 11 along the path 8A, and the guide bar 12 is unlocked. As a result, the guide bar 12 moves upwards from the position illustrated in FIG. 6A, finally reaches the position illustrated in FIG. 6B, and conveyance operation of the recording medium 9 is stopped. In FIG. 6B, the conveyance path 8 becomes a path 8B that is substantially straight. A path length L2 of the path 8B is shorter than a path length L1 of the path 8A (see FIG. 5A).

The guide bar 12 moves by the change of the load when conveying the recording medium 9, and the path of the conveyance path 8 becomes from the path 8A (see FIG. 6A) having the path length L1 to the path 8B (see FIG. 6B) having the path length L2 shorter than the path length L1. In other words, the image forming apparatus 1, an extra length (path length L1-path length L2) is generated by unlocking the guide bar 12.

The cutting unit 21 cuts the recording medium 9 from a timing that the guide bar 12 is unlocked until the recording medium 9 is conveyed by only the extra length. In other words, the cutting unit 21 cuts the recording medium 9 in the state illustrated in FIG. 6C before reaching the state as illustrated in FIG. 6B. In this way, the image forming apparatus 1 secures time for cutting the recording medium 9 by providing the extra length (path length L1-path length L2).

In this operation, a distance D1 conveyed the recording medium 9 satisfies D1<L1-L2 from a timing that the guide bar 12 is unlocked until a timing that the recording medium 9 is cut. Thus, the image forming unit 30 of latter stage can continue to form the image for the cut recording medium 9 since the cutting unit 21 can cut the recording medium 9 before the conveyance operation of the recording medium 9 stops.

In this way, in the image forming apparatus 1, the path length of the conveyance path 8 is shortened by unlocking the guide bar 12 based on the change of the load (the change of the tension of the recording medium 9) when the recording medium 9 has run out in the medium holder 11. In this way, in the image forming apparatus 1, the recording medium 9 can be cut by using the extra length since the extra length (path length L1-path length L2) occurs. At this time, the distance D1 conveyed the recording medium 9 satisfies D1<L1-L2 from the timing that the guide bar 12 is unlocked until the timing that the recording medium 9 is cut. In this way, in the image forming apparatus 1, it is possible to efficiently utilize the recording without wasting the recording medium.

More specifically, if the distance D1 does not satisfy D1<L1-L2, the cutting unit 21 cannot cut the recording medium 9 before the conveyance operation of the recording medium 9 stops. Therefore, since the conveyance operation of the recording medium 9 is stopped, the image forming unit 30 of the latter stage cannot continue the image forming operation, and a jam error causes. In this case, since the image is not formed on the recording medium 9 remained in the conveyance path 8 from the cutting unit 21 to the secondary transfer unit 45, the recording medium 9 is wasted.

Meanwhile, in image forming apparatus 1, the cutting unit 21 can cut the recording medium 9 before the conveyance operation of the recording medium 9 is stopped since the distance D1 satisfies D1<L1-L2. Therefore, since the image forming unit 30 of latter stage can continue the conveyance operation of the recording medium 9, it is possible to continue forming the image on the recording medium 9 remained in the conveyance path 8 from the cutting section 21 to the secondary transfer section 45. As a result, in the image forming apparatus 1, it is possible to efficiently utilize the recording without wasting the recording medium since the jam error does not cause.

In addition, in the image forming apparatus 1, the recording medium 9 cuts based on the change of the load (the change of the tension of the recording medium 9) when the recording medium 9 has run out in the medium holder 11. Hence, in image forming apparatus, for example, the amount of the recording medium 9 remaining in the medium holder 11 always is monitored, and the amount of waste recording medium 9 can be suppressed as compared with the case of cutting the recording medium 9 when near-end is detected.

Figure 4B:
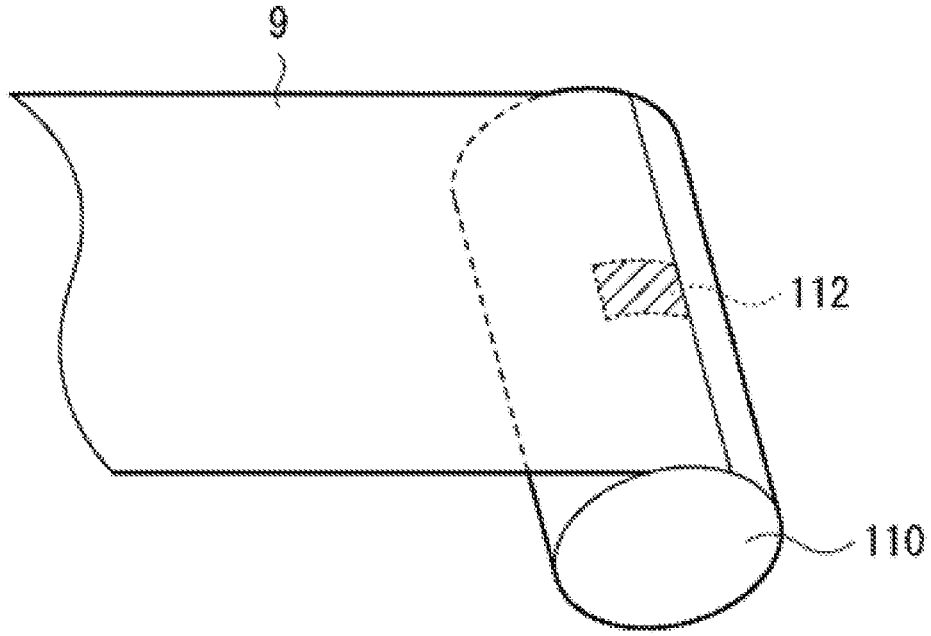
FIG. 4B is an explanatory diagram illustrating another example configuration of a recording medium illustrated FIG. 1.
Figure 4C:
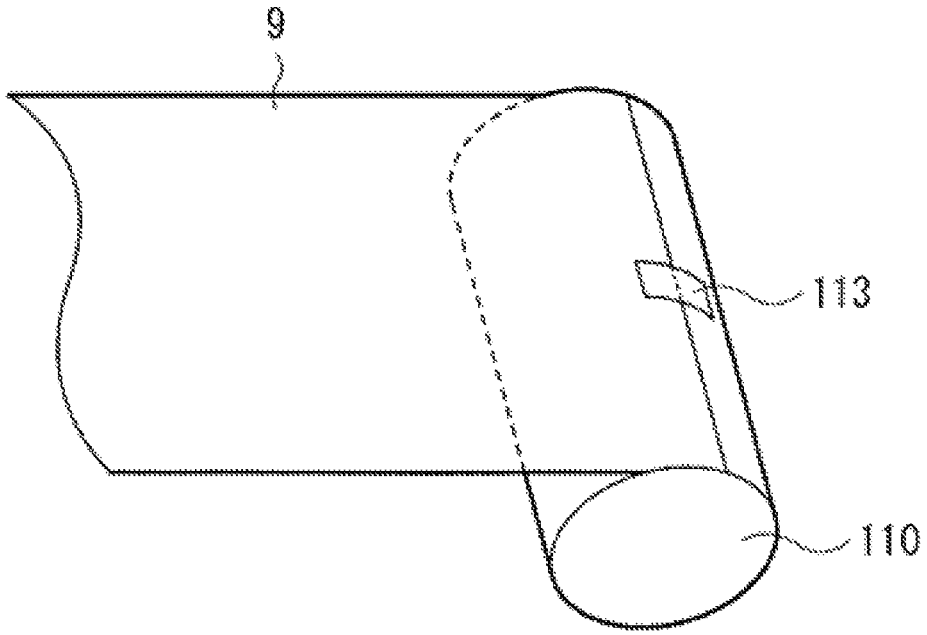
FIG. 4C is an explanatory diagram illustrating another example configuration of a recording medium illustrated FIG. 1.

In addition, in the image forming apparatus 1, even if the trailing edge of the recording medium 9 is simply fixed to the core 110 as illustrated FIG. 4B and FIG. 4C, if the guide bar 12 is unlocked based on the change of the load when the recording medium 9 has run out in the medium holder 11, it is possible to efficiently utilize the recording medium 9 without wasting the recording medium.

Next, an operation of the image forming apparatus will be described in detail by a flowchart.

Figure 7:
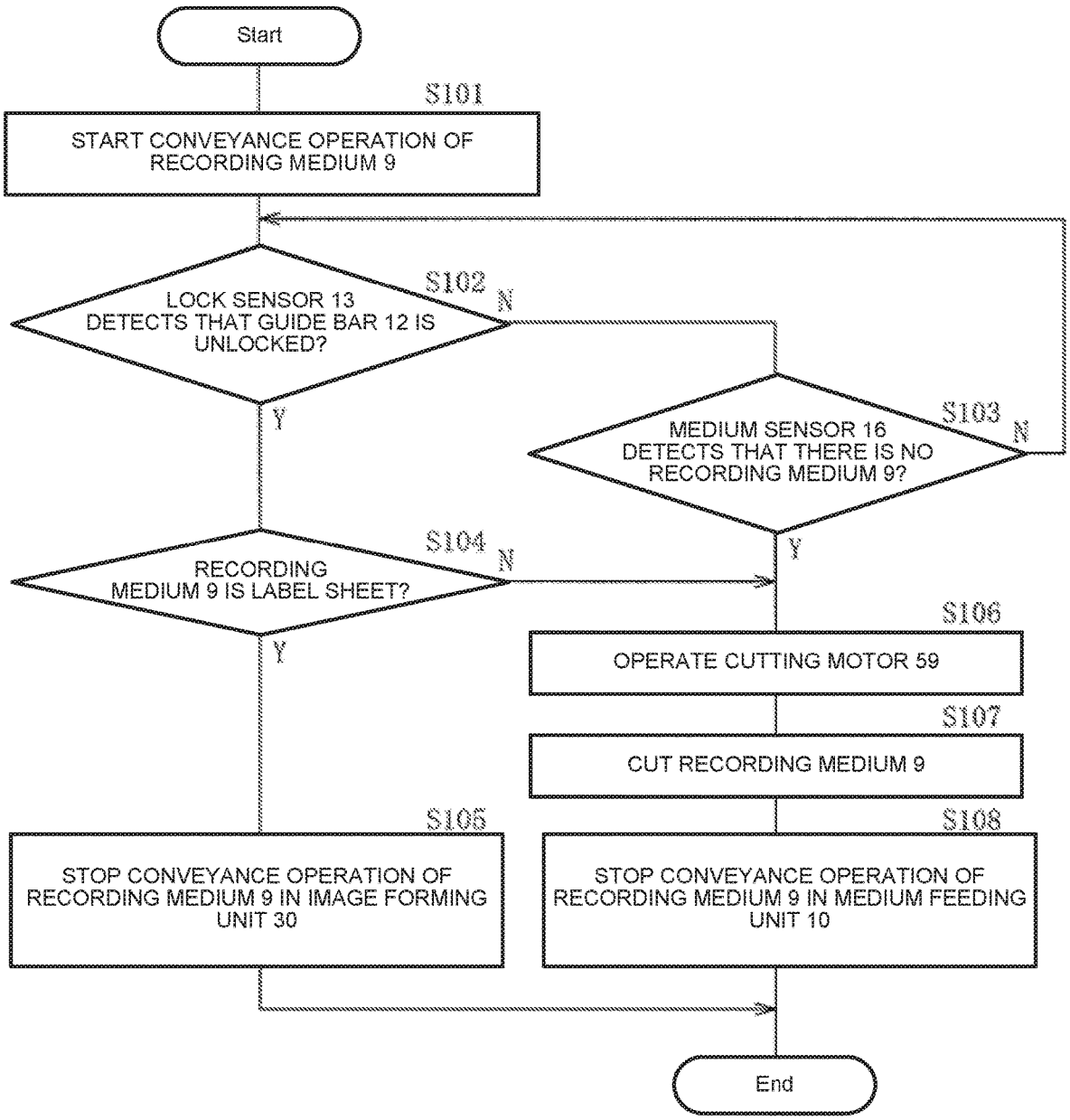
FIG. 7 is a flowchart illustrating an example operation performed by the image forming apparatus according to an embodiment.

FIG. 7 illustrates an example operation performed by the image forming apparatus 1. The image forming apparatus 1 cuts the recording medium 9 based on detection result of the lock sensor 13 and the medium sensor 16. In below, the operation will be described.

For example, the image forming apparatus 1 starts the conveyance operation of the recording medium 9 by the communication unit 61 receiving the print data DP (step S101).

Next, the controller 60 confirms whether the lock sensor 13 detects that the guide bar 12 is unlocked (step S102). That is, for example, if the trailing edge of the recording medium 9 is fixed the core 110 (see FIG. 4A), the load when conveying the recording medium 9 changes by the recording medium 9 has run out in the medium holder 11, and the guide bar 12 is unlocked. In addition, even if the trailing edge of the recording medium 9 is simply fixed the core 110 (FIG. 4B and FIG. 4C), if the trailing edge of the recording medium 9 does not easily deviate from the core 110, the load changes, and there is a possibility that the guide bar 12 is unlocked. In this case, the lock sensor 13 detects that the guide bar 12 is unlocked. In this way, the controller 60 can judge that the recording medium 9 has run out in the medium holder 11.

In step S102, if the lock sensor 13 dos not detect that the guide bar 12 is unlocked ("N" in step S102), the controller 60 confirms whether the medium sensor 16 detects that there is no recording medium 9 (step S103). More specifically, for example, if the trailing edge of the recording medium 9 is not fixed to the core 110 (FIG. 4D), even if the recording medium 9 has run out in the medium holder, the guide bar 12 is not unlocked since the load when conveying the recording medium 9 does not change. In addition, for example, even if the trailing edge of the recording medium 9 is simply fixed to the core 110 (FIG. 4B and FIG. 4C), if the recording medium 9 easily deviates from the core 110, and the change of the load is small, there is a possibility that the guide bar 12 may not be unlocked. In this case the medium sensor 16 detects that there is no recording medium 9. As a result, the controller 60 can judge that the recording medium 9 has run out in the medium holder 11.

In step S103, if the medium sensor 16 does not detect that there is no recording medium 9 ("N" in step S103), the flow returns to step S102. The step S102 and S103 repeat until the lock sensor 13 detects that the guide bar 12 is unlocked or the medium sensor 16 detects that there is no the recording medium 9.

In step S102, if the lock sensor 13 detects that the guide bar 12 is unlocked ("Y" in the step S102), the controller 60 confirms whether the recording medium 9 is the label sheet (step S104). For example, if the print data DP includes information about the type of the recording medium 9, the controller 60 can confirm whether the recording medium 9 is the label sheet based on this print data DP. Further, for example, if in a case that the user input information about the type of the recording medium 9 by operating the display operation unit 51, the controller 60 can confirm whether the recording medium 9 is the label sheet based on this input information.

In step S104, if the recording medium 9 is the label sheet ("Y" in step S104), the image forming apparatus 1 stops the conveyance operation of the recording medium 9 in the image forming unit 30 (step S105). Specifically, the motor controller 65 of the controller 60 is stopped the conveyance operation of the recording medium 9 in the image forming unit 30 by being stopped the operation of the conveyance motor 55 and the ejecting motor 56. More specifically, for example, if the recording medium 9 is the label sheet 9A, the image forming apparatus 1 usually cuts at the gap 103 of the label sheet 9A. In this case, if the image forming apparatus 1 cuts the recording medium 9 at part other than the gap 103 when the recording medium 9 has run out in the medium holder 11, the image forming unit 30 may be damaged by entering a paper strip of the cut recording medium 9 into the image forming unit 30. Therefore, in this example, if the recording medium 9 is the label sheet, the conveyance operation of the recording medium 9 in the image forming unit 30 is stopped without cutting this label sheet. Then, this flow is ended.

In step S104, if the recording medium 9 is not the label sheet ("N" in step S104), or in step S103, if the medium sensor 16 detects that there is no recording medium 9 ("Y" in step S103), the cutting controller 66 of the controller 60 is operated the cutting motor 59 (step S106). Further, the cutting unit 21 cuts the recording medium 9 by rotating the blade of the cutter based on driving power transmitted from the cutting motor 59 (step S107). Further, the image forming apparatus 1 stops the conveyance operation of the recording medium 9 in the medium feeding unit 10 (step S108). Specifically, the motor controller 65 of the controller 60 is stopped the conveyance operation of the recording medium 9 in medium feeding unit 10 by being stopped the operation of the medium feeding motor 54. Further, this flow is ended.

In this way, the image forming apparatus 1 cuts the recording medium 9 based on detection result of the medium sensor 16 in addition to detection result of the lock sensor 13. Therefore, for example, even if the trailing edge of the recording medium 9 is not fixed to the core 110 (see FIG. 4D), the image forming apparatus 1 can cut the recording medium 9. As the result, in the image forming apparatus 1, it is possible to efficiently utilize the recording medium 9 without wasting the recording medium.

In addition, in the image forming apparatus 1, if the recording medium is cut, the conveyance operation of the recording medium 9 in the medium feeding unit 10 is stopped. In this way, for example, the recording medium 9 on the upstream of the cutting unit 21 does not enter the image forming unit 30 of the latter stage in the trailing edge of the recording medium 9 is not fixed to the core 110 (see FIG. 4D). Hence, in the image forming apparatus 1, it is possible to reduce the risk that the image forming unit 30 is damaged.

In addition, in the image forming apparatus 1, even if the guide bar 12 is unlocked, if the recording medium 9 is the label sheet, the recording medium 9 is not cut. Hence, it is possible to reduce the risk that the image forming unit 30 is damaged by a paper strip of the recording medium 9 entering into the image forming unit 30.

As described above, according to the present embodiment, the path length of the conveyance path is shortened by unlocking the guide bar based on the change of the load (the change of tension of the recording medium) when the recording medium has run out in the medium holder. Hence, the recording medium can be cut by using this extra length. Hence, it is possible to efficiently utilize the recording medium without wasting the recording medium since the image forming unit continues the conveyance operation of the recording medium. Further, the conveyance operation of the recording medium in medium feeding unit is stopped. Hence, it is possible to reduce the risk that the image forming unit is damaged.

In the present embodiment, the recording medium is cut based on detection result of the medium sensor in addition to detection result of the lock sensor. Hence, for example, even if the trailing edge of the recording medium is not fixed to the core, it is possible to efficiently utilize the recording without wasting the recording medium.

In the present embodiment, even if the guide bar is unlocked, if the recording medium is the label sheet, the recording medium is not cut. Hence, it is possible to reduce the risk that the image forming unit is damaged.

Figure 8:
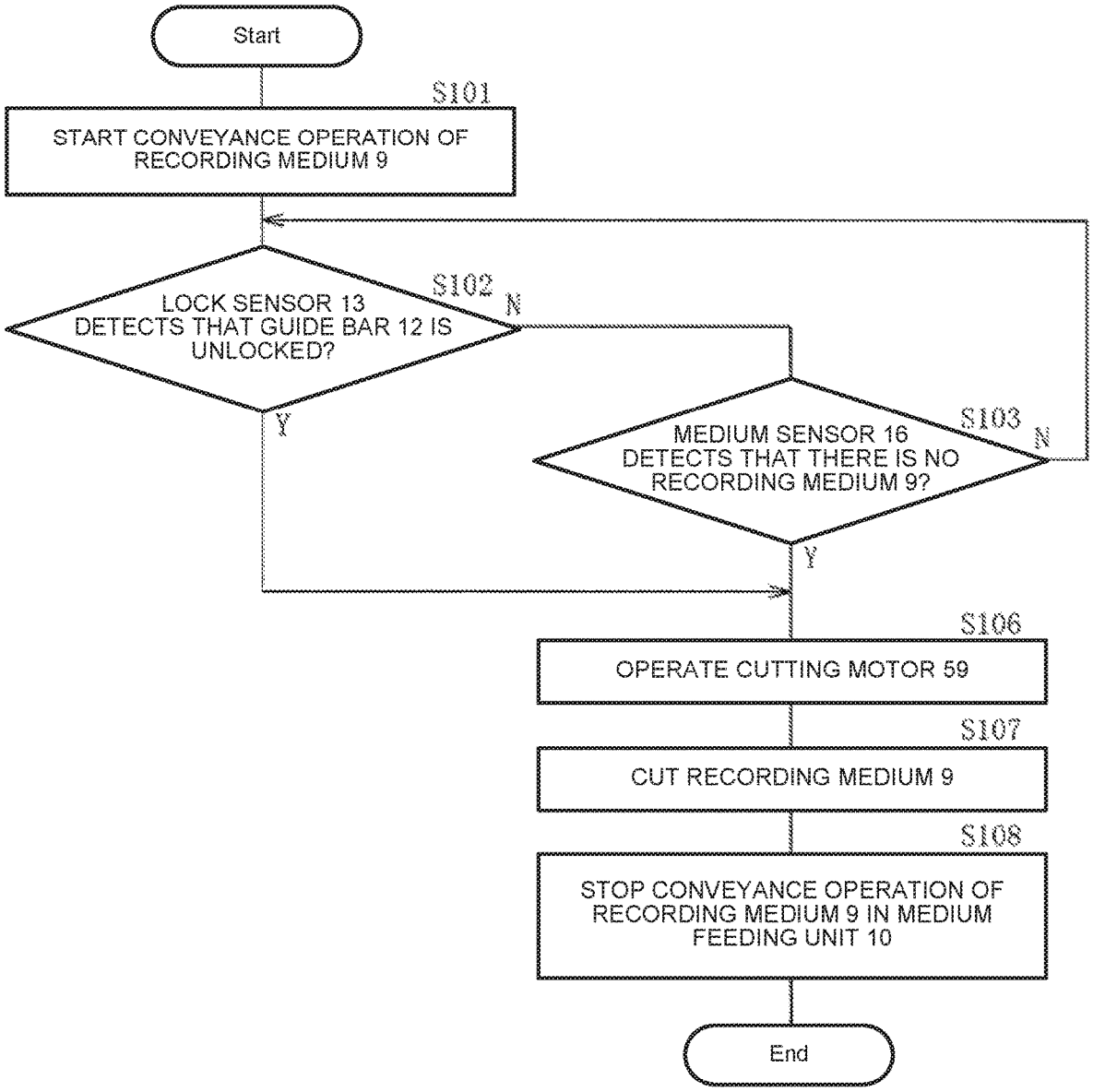
FIG. 8 is a flowchart illustrating an example operation performed by the image forming apparatus according to an embodiment.

In the above embodiment, even if the guide bar 12 is unlocked, if the recording medium is the label sheet, the recording medium 9 is not cut, but it is not limited thereto. Alternatively, for example, even if the paper strip of the recording medium 9 enters into the image forming unit 30, if the image forming unit 30 does not receive much damage, the recording medium 9 may be cut despite the type of the recording medium 9 as illustrated in FIG. 8. According to this example, in step S102, if the lock sensor 13 detect that the guide bar 12 is unlocked ("Y" in step S102), the cutting controller 66 of the controller 60 is operated the cutting motor 59 (step S106), and the cutting unit 21 cuts the recording medium 9 (step S107). At this time, for example, if the recording medium 9 is the label sheet 9A, the cutting unit 21 can cut the recording medium 9 at the position other than the gap 103. The image forming apparatus 1 stops the conveyance operation of the recording medium 9 in the medium feeding unit 10 (step S108). Hence, it is possible to efficiently utilize the recording without wasting the recording medium despite the type of the recording medium 9.

(2) Second Embodiment

An image forming apparatus 2 according to a second embodiment will be described. The second embodiment is different from the above first embodiment in the operation when the lock sensor 13 detects that the guide bar 12 is unlocked. It is to be noted that component parts that are substantially the same as those of the image forming apparatus 1 according to the above first embodiment are denoted with the same numerals and repeated explanation of these components is omitted.

As illustrated in FIG. 5, the image forming apparatus 2 includes a controller 70. The controller 70 includes a cutting controller 76. In the case that the recording medium 9 is the label sheet, if the guide bar 12 is unlocked and the gap 103 can be detected within the extra length range (path length L1-path length L2), the cutting controller 76 controls the operation of the cutting motor 59 such that the cutting unit 21 cuts the recording medium 9 at the gap 103.

Figure 9:
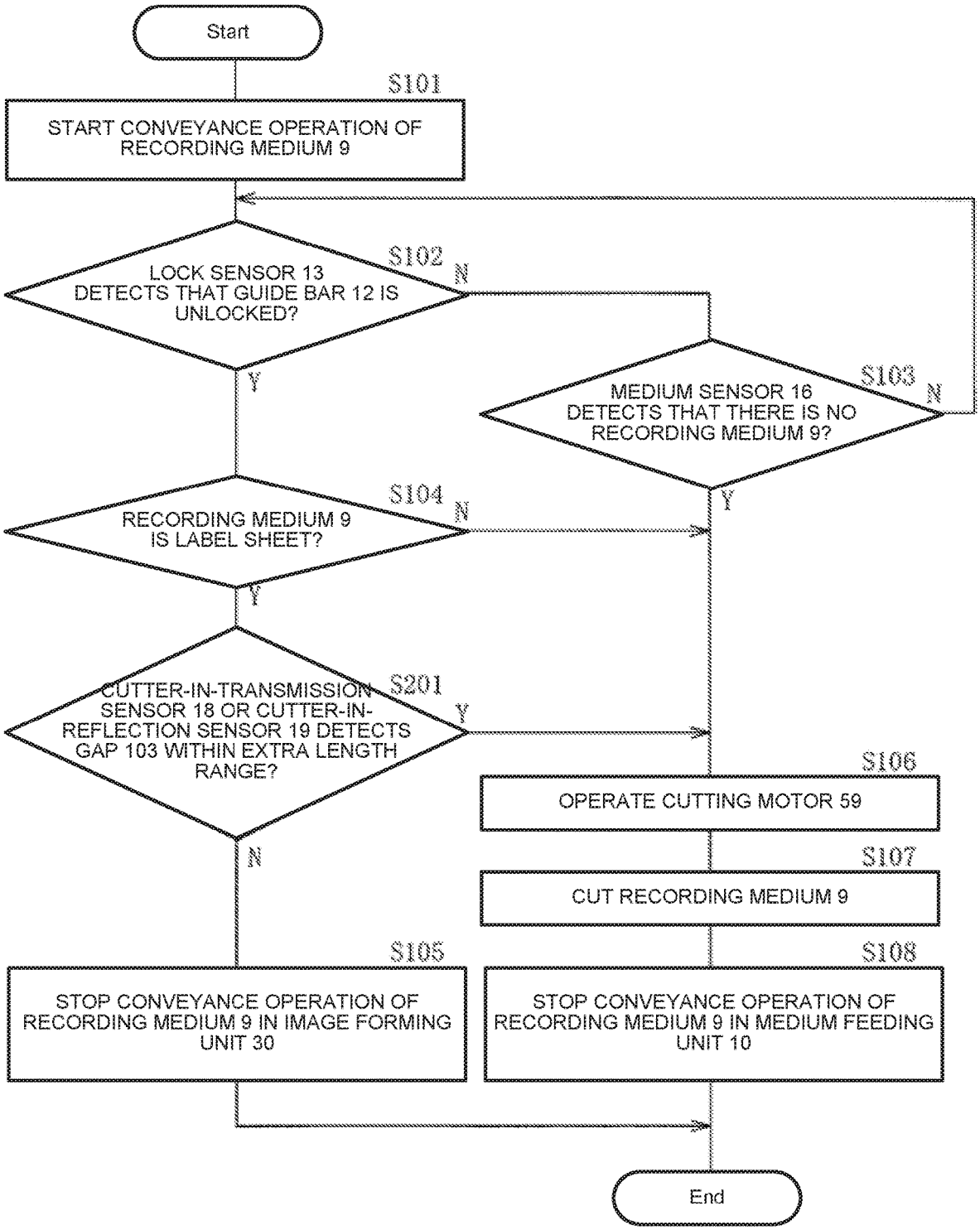
FIG. 9 is a flowchart illustrating an example operation performed by the image forming apparatus according to an embodiment.

FIG. 9 illustrates an example operation performed by the image forming apparatus 2.

For example, the image forming apparatus 2 starts conveyance operation of the recoding medium 9 by the communication unit 61 receiving the print data DP (step S101).

Next, the controller 70 confirms whether the lock sensor 13 detects that the guide bar 12 is unlocked (step S102). Further, if the lock sensor 13 does not detect that the guide bar 12 is unlocked ("N" in step S102), the controller 70 confirms whether the medium sensor 16 detects that there is no recording medium 9 (step S103). If the medium sensor 16 does not detect that there is no recording medium 9 ("N" in step S103), the flow returns to step S102. Further, the step S102 and S103 repeat until the lock sensor 13 detects that the guide bar 12 is unlocked or the medium sensor 16 detects that there is no the recording medium 9.

In step S102, if the lock sensor 13 does not detect that the guide bar 12 is unlocked ("Y" in step S102), the controller 70 confirms whether the recording medium 9 is the label sheet (step S104).

In step S104, if the recording medium 9 is the label sheet ("Y" in step S104), the controller 70 confirms whether the cutter-in-transmission sensor 18 or the cutter-in-reflection sensor 19 detects the gap 103 within the extra length range (step S201). Specifically, since the image forming apparatus 2 can convey the recording medium 9 by only the extra length (path length L1-path length L2), in the recording medium 9 having a length corresponding to this extra length, the cutter-in-transmission sensor 18 or the cutter-in-reflection sensor 19 may detect the gap 103. Therefore, the controller 70 confirms whether the cutter-in-transmission sensor 18 or the cutter-in-reflection sensor 19 detects the gap 103 within this extra length range. If the cutter-in-transmission sensor 18 or the cutter-in-reflection sensor 19 does not detect the gap 103 within the extra length range ("N" in step S201), the image forming apparatus 2 stops the conveyance operation of the recording medium 9 in the image forming unit 30 (step S105).

If the recording medium 9 is not the label sheet ("N" in step S104), the medium sensor detects that there is no recording medium 9 ("Y" in step S103), or the cutter-in-transmission sensor 18 or the cutter-in-reflection sensor 19 detects the gap 103 within the extra length range ("Y" in step S201), the cutting controller 76 of the controller 70 is operated the cutting motor 59 (step S106), and the cutting unit 21 cut the recording medium 9 (step S107). Especially, if the cutter-in-transmission sensor 18 or the cutter-in-reflection sensor 19 detects the gap 13 within the extra length range ("Y" in step S201), the cutting unit 21 cuts the recording medium 9 at the gap 103 detected. Further, the image forming apparatus 2 stops the conveyance operation of the recording medium 9 in the medium feeding unit 10 (step S108). Further, this flow is ended.

As described above, in the image forming apparatus 2, in the case that the recording medium 9 is the label sheet, if the guide bar 12 is unlocked and the gap 103 can be detected within the extra length range the cutting unit 21 cuts the recording medium 9 at the gap 103. In the image forming apparatus 2, it is not only the recording medium 9 is cut the during normal operation but also the recording medium 9 has run out in the medium holder 11, since the recording medium is cut at gap 103, it is possible to efficiently utilize the recording medium without wasting the recording medium.

As described above, according to the present embodiment, in the case that the recording medium is a label sheet, if the guide bar is unlocked and the gap can be detected within the extra length range, the cutting unit cuts the recording medium at the gap. Hence, it is possible to efficiently utilize the recording medium without wasting the recording medium. Other effects may be similar to or the same as in the above first embodiment.

(3) Third Embodiment

An image forming apparatus 3 according to a third embodiment will be described. The third embodiment judges whether to cut the recording medium 9 based on the distance conveyed the recording medium 9 since a last cutting of the recording medium 9, when cutting the recording medium 9 based on detection results of the lock sensor 13 and the medium sensor 16. It is to be noted that component parts that are substantially the same as those of the image forming apparatus 1 according to the above first embodiment are denoted with the same numerals and repeated explanation of these components is omitted.

Figure 10:
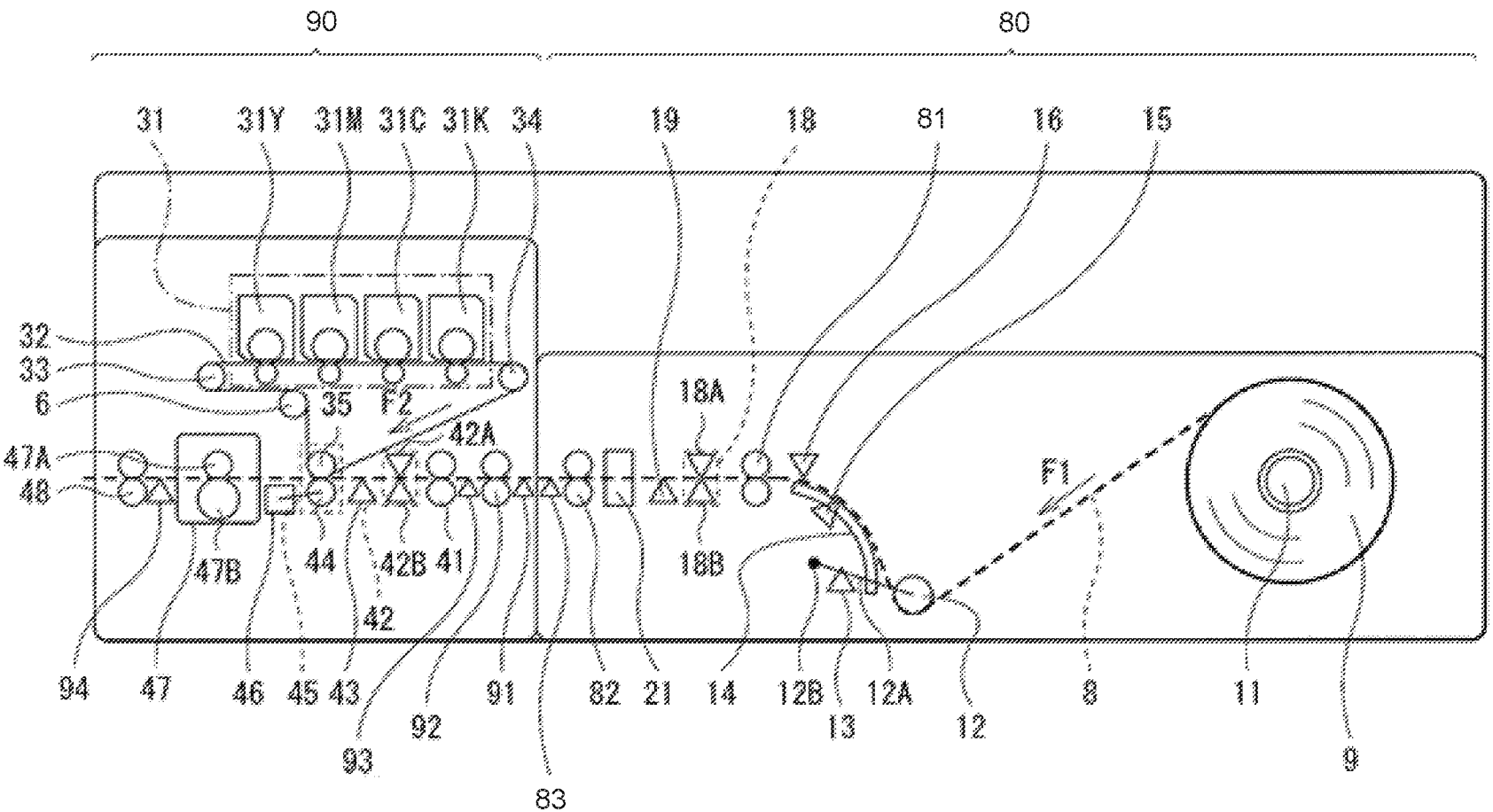
FIG. 10 is a configuration diagram illustrating an example configuration of the image forming apparatus according to an embodiment.

FIG. 10 illustrates an example configuration of the image forming apparatus 3. The image forming apparatus 3 includes a medium feeding unit 80 and a image forming unit 90.

The medium feeding unit 80 includes a medium feeding roller 81, a conveyance roller 82, a cutter-out sensor 83. The medium feeding roller 81 is arranged between a medium sensor 16 and a cutter-in-transmission sensor 18. Further, the conveyance roller 82 and the cutter-out sensor 83 are arranged in this order downstream of a cutting unit 21.

The medium feeding roller 81 includes a pair of roller across the conveyance path 8. The medium feeding roller 81 conveys the recording medium 9 along the conveyance path 8 based on driving power transmitted via a clutch 152 which described later from the medium feeding motor 54.

The conveyance roller 82 includes a pair of the roller across the conveyance path 8. The conveyance roller 92 conveys the recording medium 9 along the conveyance path 8 based on driving power transmitted via clutch 153 which described later from the medium feeding motor 54, and feeds the recording medium 9 to image forming unit 90.

The cutter-out sensor 83 detects whether the recording medium 9 passes through the conveyance roller 82.

The image forming unit 90 includes a medium sensor 91, a conveyance roller 92, a medium sensor 93, and an ejecting sensor 94. The medium sensor 91, the conveyance roller 92 and a medium sensor 93 are arranged in this order upstream of the conveyance roller 41 in the image forming unit 90. The ejection sensor 94 is arranged between the fixing unit 47 and the ejection roller 48.

The medium sensor 91 detects passage of the recording medium 9.

The conveyance roller 92 includes a pair of roller across the conveyance path 8. The conveyance roller 92 conveys the recording medium 9 fed from the medium feeding unit 80 along the conveyance path 8 based on driving power transmitted from the conveyance motor 55.

The medium sensor 93 detects passage of the recording medium 9.

The ejecting sensor 94 detects ejection of the recording medium 9 from the image forming apparatus 3.

Figure 11A:
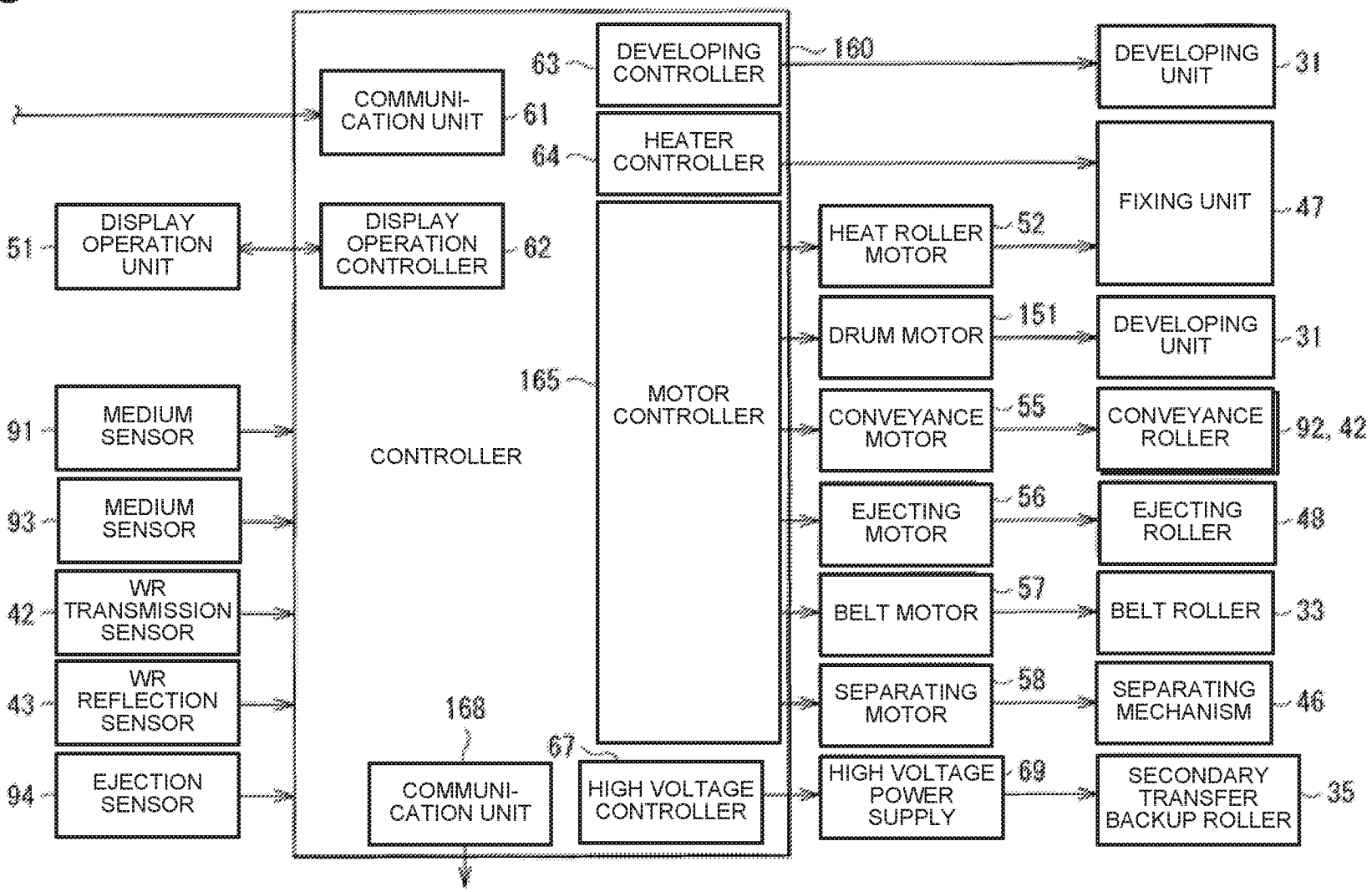
FIG. 11A is a block diagram illustrating an example configuration a control mechanism of the image forming apparatus illustrated FIG. 10.
Figure 11B:
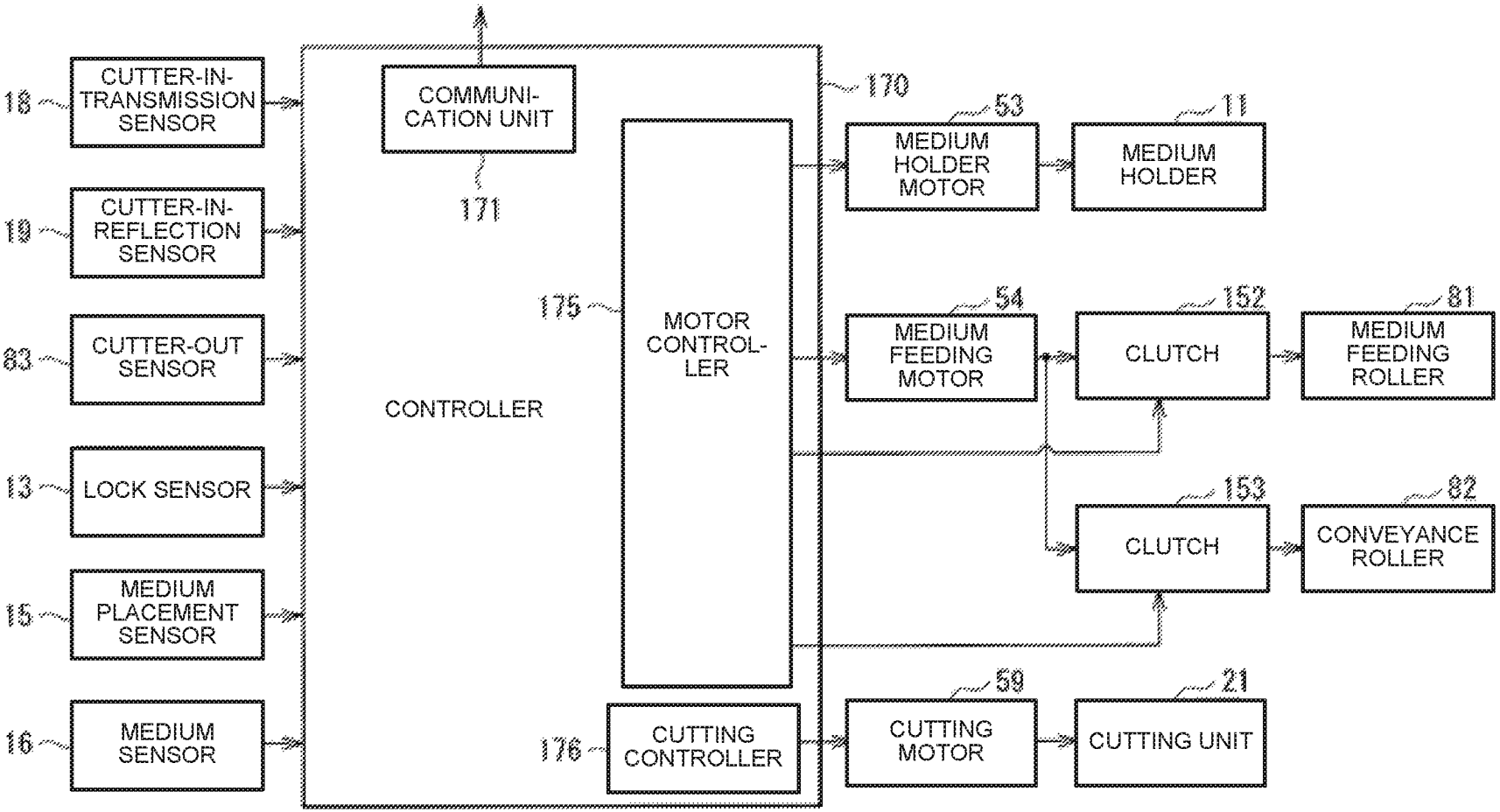
FIG. 11B is a block diagram illustrating an example configuration of a control mechanism of the image forming apparatus illustrated FIG. 10.

FIG. 11 A and FIG. 11B illustrate an example of a control mechanism in the image forming apparatus 3. FIG. 11A illustrates an example of a control mechanism in the image forming unit 90. FIG. 11B illustrates an example of a control mechanism in the medium feeding unit 80. The image forming apparatus 3 includes a controller 160, a controller 170, a clutch 152, and a clutch 153.

The controller 160 controls the operation of the image forming unit 90. In addition, the controller 160 has a function that communicates with the controller 170 that controls the operation of the medium feeding unit 80. The controller 160 includes a motor controller 165, and a communication unit 168. The motor controller 165 controls the operation of the heat roller motor 52, the drum motor 151, the conveyance motor 55, the ejecting motor 56, the belt motor 57, and separating motor 58. The communication unit 168 communicates with the controller 170 that controls the operation of the medium feeding unit 80.

The controller 170 controls the operation of the medium feeding unit 80. Further, the controller 170 has a function that communicates with the controller 160 that controls the operation of the image forming unit 90. The controller 170 includes a communication unit 171, a motor controller 175, and a cutting controller 176. The communication 171 communicates with the controller 160 that controls the operation of the image forming unit 90. The motor controller 175 controls the operation of the medium holder motor 53 and the medium feeding motor 54. Further, the motor controller 175 controls the operation of the clutch 152 and the clutch 153. The cutting controller 176 controls the operation of the cutting motor 59. Specifically, the cutting controller 176 judges whether to cut the recording medium 9 based on the distance conveyed the recording medium 9 since the last cutting of the recording medium 9, when cutting the recording medium 9 based on detection results of the lock sensor 13 and the medium sensor 16.

The clutch 152 is a member that transmits or blocks driving power suppled from the medium feeding motor 54 to the medium feeding roller 81 Based on an instruction from the motor controller 175.

The clutch 153 is a member that transmits or blocks driving power supplied from the medium feeding motor 54 to the conveyance roller 82 based on an instruction from the motor controller 175.

In this example, the medium feeding roller 81 corresponds to one specific example of "first conveyance member" in the present invention. The conveyance roller 82 corresponds to one specific example of "third conveyance member" in the present invention. The medium feeding motor 54 corresponds to one specific example of "driving motor" in the present invention. The clutch 153 corresponds to one specific example of "transmission unit" in present invention.

FIG. 12 illustrates an example operation performed by the image forming apparatus 3.

For example, the image forming apparatus 3 starts the conveyance operation of the recording medium 9 by the communication unit 61 receiving the print data DP (step S101).

Next, the controller 170 confirms whether the lock sensor 13 detects that the guide bar 12 is unlocked (step S102). Further, if the lock sensor 13 does not detect that the guide bar 12 is unlocked ("N" in step S102), the controller 170 confirms whether the medium sensor 16 detects that there is no recording medium 9 (step S103). If the medium sensor 16 does not detects that there is no recording medium 9 ("N" in step S103), the flow returns to step S102. Further, the step S102 and S103 repeat until the lock sensor 13 detects that the guide bar 12 is unlocked or the medium sensor 16 detects that there is no the recording medium 9.

In step S102, if the lock sensor 13 detects that the guide bar 12 is unlocked ("Y" in step S102), the controller 170 confirms whether the recording medium 9 is the label sheet (step S104). If the recording medium is the label sheet ("Y" in the step S104), the motor controller 175 of the controller 170 is set to off state (blocked state) the clutch 152 and the clutch 153 (step S301). Hence, the medium feeding roller 81 and the conveyance roller 82 of the medium feeding unit 80 stops the conveyance operation of the recording medium 9. Further, this flow proceeds to step S306.

If the recording medium 9 is not the label sheet ("N" in step S104), or the medium sensor 16 detects that there is no recording medium 9 ("Y" in step S103), the controller 170 conforms whether the recording medium 9 is conveyed a predetermined distance or more since the last cutting of the recording medium 9 (step S302). Specifically, the controller 170 confirms whether the recording medium 9 is conveyed a predetermined distance or more based on the number of rotations of the medium feeding motor 54 after the cutter-out sensor 83 detects the a leading edge of the recording medium 9 when the cutting unit 21 cuts the recording medium 9 at the end. For example, this predetermined distance is the minimum medium length of the recording medium 9 that can be conveyed when the image forming apparatus 3 conveys the recording medium 9 along the conveyance path 8. For example, this predetermined distance may be about four inches. If the recording medium 9 is not conveyed the predetermined distance or more ("N" in step S302), this flow proceeds to step S301.

In step S302, if the recording medium 9 is conveyed the predetermined distance or more ("Y" in step S302), the cutting controller 176 is operated the cutting motor 59 (step S106). Further, the cutting unit 21 cuts the recording medium 9 by rotating the blade of the cutter based on driving power transmitted from the cutting motor 59 (step S107). Hence, the medium length of cut recording medium 9 has a length equal to or longer than the minimum conveyable medium length.

Further, the motor controller 175 is set to off state (blocked state) the clutch 152 (step S303). Hence, the medium feeding roller 81 arranged the upstream of the cutting unit 21 stops the conveyance of the recording medium 9.

Next, the controller 170 confirms whether the trailing edge of the cut recording medium 9 in step S107 has passed through the conveyance roller 82 arranged downstream of the cutting unit 21 (step S304). Specifically, the controller 170 confirms whether the trailing edge of the recording medium 9 has passed through the conveyance roller 82 by confirming whether the cutter-out sensor 83 detects the trailing edge of the recording medium 9. If the trailing edge of the recording medium 9 still does not pass through the conveyance roller 82 ("N" in step S304), this step S304 repeats until passing thorough the conveyance roller 82.

Further, in step S304, if the trailing edge of the recording medium 9 has passed through the conveyance roller 82 ("Y" in step S304), the motor controller 175 is set to off state (blocked state) the clutch 153 (step S305). Hence, the conveyance roller 82 arranged the downstream of the cutting unit 21 stops the conveyance of the recording medium 9.

Further, the motor controller 175 is stopped the operation of the medium feeding motor 54.

This flow is thus ended.

Hence, in the image forming apparatus 3, if the recording medium 9 is conveyed the predetermined distance or more since the last cutting of the recording medium 9, the recording medium 9 is cut. Hence, for example, the medium length of cut recording medium 9 can make a length equal to or longer than the minimum conveyable medium length. As a result, in the image forming apparatus 3, it is possible to reduce the risk that the cut recording medium 9 is not conveyed and is remained in the image forming apparatus 3.

In addition, in the image forming apparatus 3, the clutch 152 is set to off state (blocked state) after cutting the recording medium 9, and the clutch 153 is set to off state (blocked state) after the trailing edge of the recording medium 9 has passed through the conveyance roller 82. More specifically, if the cutting unit 21 cuts the recording medium 9 and the clutch 152 is set to off state (blocked off), the clutch 153 is maintained on state (transmitted state). Therefore, in the image forming apparatus 3, the conveyance of the recording medium 9 can be stopped at upstream of the cutting unit 21 and the recording medium 9 can be continued to convey at downstream of cutting unit 21.

Next, the operation of the image forming apparatus 3 will be described referring to some specific examples.

Figure 4D:
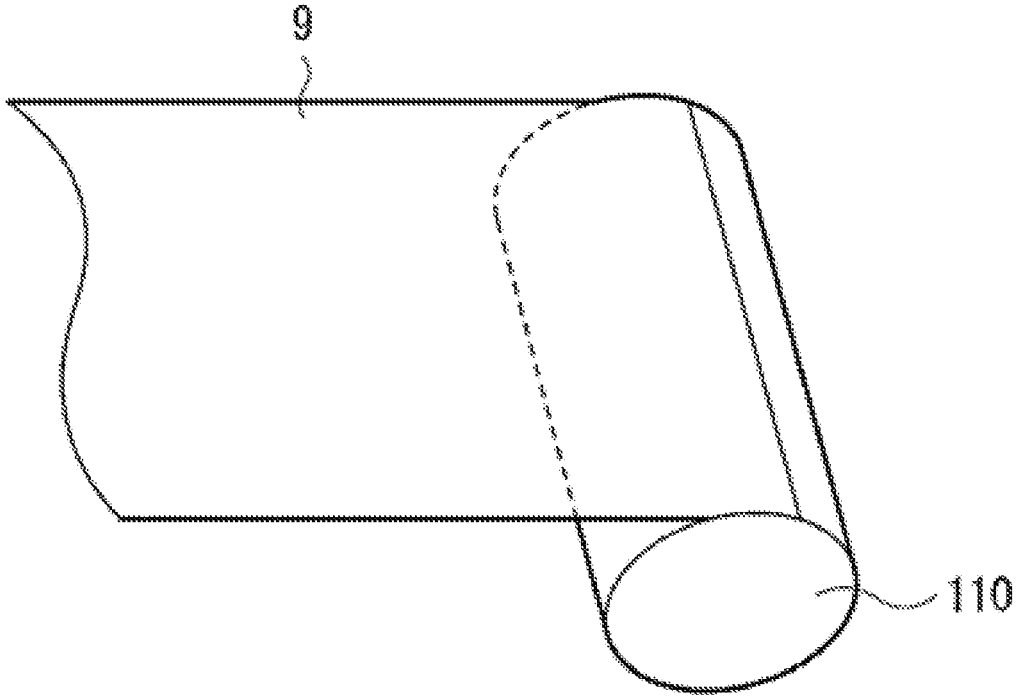
FIG. 4D is an explanatory diagram illustrating another example configuration of a recording medium illustrated FIG. 1.
Figure 13:
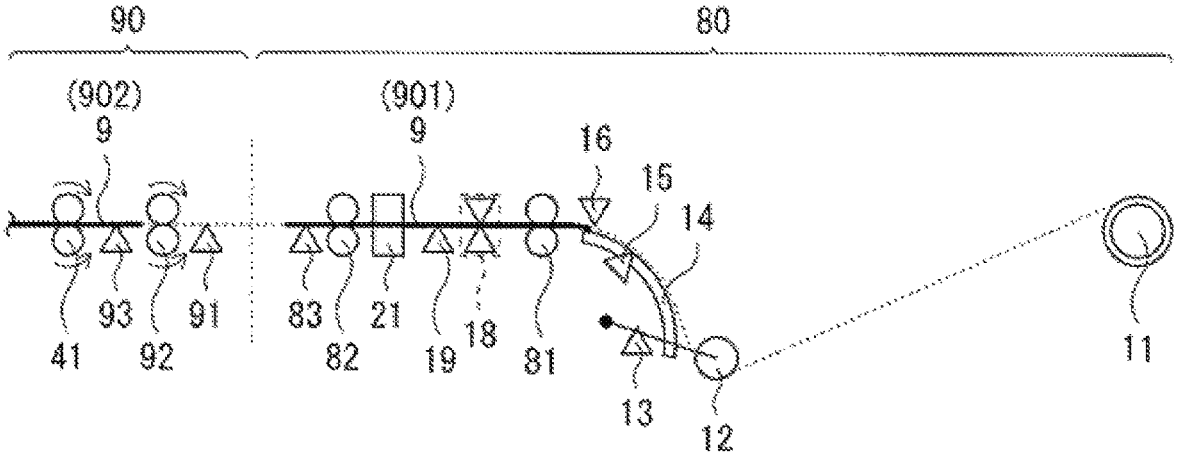
FIG. 13 is an explanatory diagram illustrating an example operation performed by the image forming apparatus illustrated FIG. 10.

FIG. 13 illustrates a case that the medium sensor 16 detects that there is no recording medium 9, and illustrates the operation state of the image forming apparatus 3 in a case where the recording medium 9 is not cut. In this example, the trailing edge of the recording medium 9 is not fixed to the core 110 as illustrated in FIG. 4D. In the image forming apparatus 3, since the medium sensor 16 detects that there is no recording medium 9 ("Y" in step S103) in step S103 of FIG. 12, and the recording medium 9 is not conveyed a predetermined distance or more since the last cutting of the recording medium 9 ("N" in step S302), the motor controller 175 of the controller 170 is set to off state (blocked state) the clutch 152 and the clutch 153 (step S301). Hence, the medium feeding roller 81 of the medium feeding unit 80 and the conveyance roller 82 stop the conveyance of the recording medium 9 (recording medium in FIG. 13).

Meanwhile, in downstream of the cutting unit 21, the conveyance roller 92 and the conveyance roller 41 of the image forming unit 90 continue to convey the cut recording medium 9 (recording medium 902). The recording medium 902 is cut before the medium sensor 16 detects the trailing edge of the recording medium 901, for example, is cut at position instructed by the print data DP. Further, image forming apparatus 3 forms the image to recording medium 902 based on the print data DP and ejects the recording medium 902. In short, the recording medium 902 is formed the desired image in accordance with the print data DP.

Further, the user can easily remove the recording medium 901 remaining the medium feeding unit 80 by opening a cover of the image forming apparatus 3. More specifically, the medium feeding roller 82 and the conveyance roller 82 rotate easily by the user pulls out the recording medium 901 since the clutch 152 and the clutch 153 are set to the off state (blocked state). Therefore, the user can easily pull out the recording medium 901 in either the conveyance direction F1 or the direction opposite to the conveyance direction F1. Hence, the user can easily remove the recording medium 901.

Figure 14:
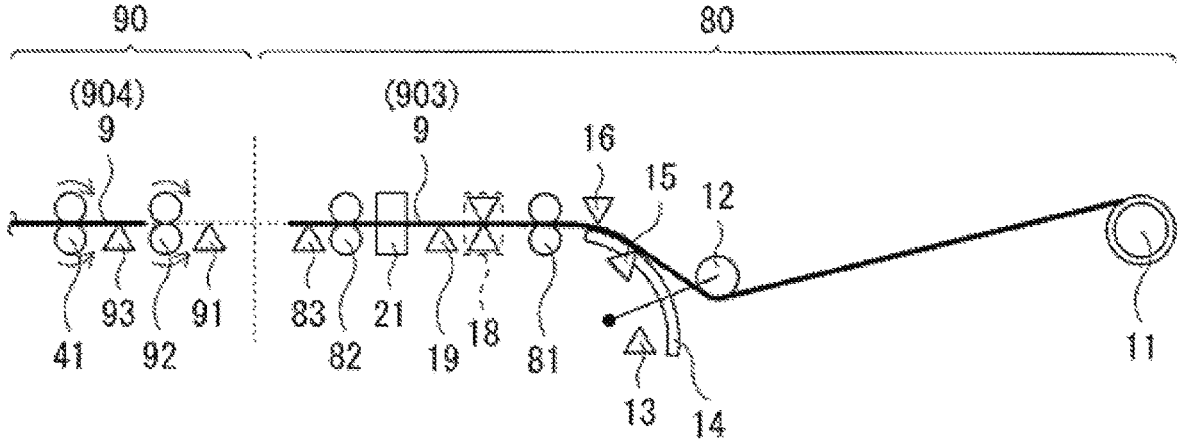
FIG. 14 is an explanatory diagram illustrating an example operation performed by the image forming apparatus illustrated FIG. 10.

FIG. 14 illustrates a case that the lock sensor 13 detects that the guide bar 12 is unlocked, and illustrates the operation state of the image forming apparatus 3 in a case where the recording medium 9 is not cut. In this example, the trailing edge of the recording medium 9 is fixed the core 110 as illustrated in FIG. 4A. In image forming apparatus 3, if the lock sensor 13 detects that the guide bar 12 is unlocked in step S102 of FIG. 12 ("Y" in step S102) and the recording medium 9 is the label sheet ("Y" in step S104), or if the recording medium 9 is not the label sheet ("N" in step S104) and the recording medium 9 is not conveyed the predetermined distance or more since the last cutting of the recording medium 9 ("N" in step S302), the motor controller 175 of the controller 170 is set to off state (Blocked state) the clutch 152 and the clutch 153 (step S301). Hence, the medium feeding roller 81 and the conveyance roller 82 of the medium feeding unit 80 stop the conveyance of the recording medium 9 (recording medium 903 in FIG. 14). The medium feeding roller 81 and the conveyance roller 82 stop the conveyance of the recording medium 903 from a timing that the guide bar 12 is unlocked until the recording medium 903 is conveyed by only the extra length (path length L1-path length L2) described in the first embodiment. Hence, in the image forming apparatus 3, it is possible to reduce the risk of damage to the medium feeding unit 80 or various rollers or the like. More specifically, if the conveyance of the recording medium is not stopped until the recording medium 903 is conveyed by only the extra length, the recording medium 9 cannot be conveyed as illustrated in FIG. 6B since the trailing edge of the recording medium 903 is fixed to the core 110. Hence, the impact occurs in the medium feeding unit 80, there is a risk of damage to the medium feeding unit 80 or various rollers or the like. Meanwhile, the image forming apparatus 3, the conveyance of the recording medium 903 is stopped until the recording medium 903 is conveyed by only the extra length (path length L1-path length L2). Hence, it is possible to reduce the risk of impact on the medium feeding unit 80 and to reduce the risk of damage to the medium feeding unit 80 or various rollers or the like.

Meanwhile, in downstream of the cutting unit 21, the conveyance roller 92 and the conveyance roller 41 of the image forming unit 90 continue to convey the cut recording medium 9 (recording medium 904). Further, the image forming apparatus 3 forms the image to the recording medium 904 based on the print data DP, and ejects the recording medium 904.

Further, for example, the user can easily remove the recording medium 903 remaining the medium feeding unit 80 by opening the cover of the image forming apparatus 3.

Figure 15:
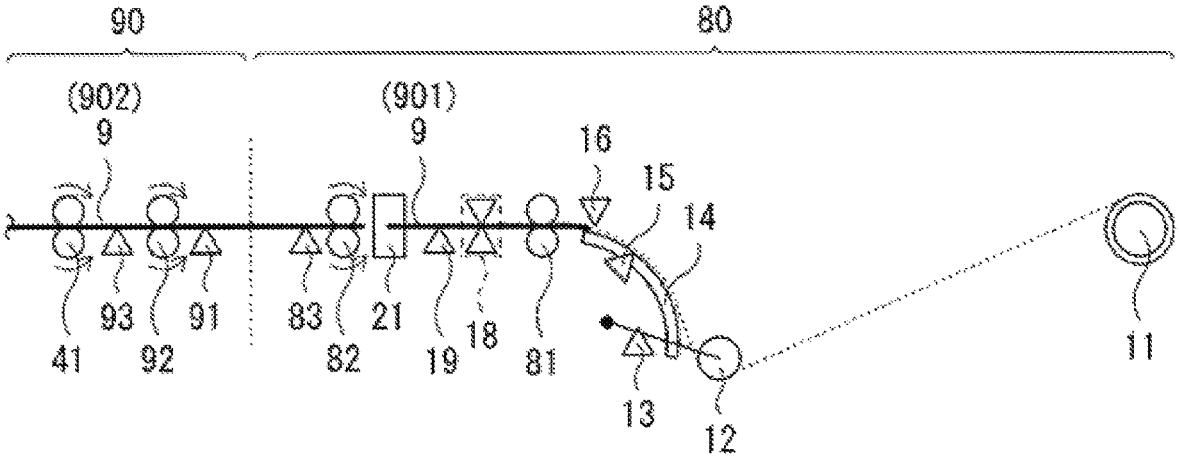
FIG. 15 is an explanatory diagram illustrating an example operation performed by the image forming apparatus illustrated FIG. 10.

FIG. 15 illustrates a case that the medium sensor 16 detects that there is no recording medium 9, and illustrates the operation state of the image forming apparatus 3 in a case where the recording medium 9 is cut. In this example, the trailing edge of the recording medium 9 is not fixed to the core 110 as illustrated in FIG. 4D. In the image forming apparatus 3, since the medium sensor 16 detects that there is no recording medium 9 ("Y" in step S103) in step S103 of FIG. 12, and the recording medium 9 is conveyed the predetermined distance or more since the last cutting of the recording medium 9 ("Y" in step S302), the cutting unit 21 cuts the recording medium 9 (step S106 and Step S107). Further, the motor controller 175 of the controller 170 is set to off (blocked state) the clutch 152 (step S303). Hence, the medium feeding roller 81 of the medium feeding unit 80 stops the conveyance of the recording medium 9 (recording medium 905 in FIG. 15).

Meanwhile, in downstream of the cutting unit 21, the conveyance roller 82 of the medium feeding unit 80 and the conveyance roller 92 and the conveyance roller 41 of the image forming unit 90 continue to convey the cut recording medium 9 (recording medium 906). This recording medium 906 is cut at step S107, the medium length of the recording medium 906 is shorter than the medium length instructed by the print data DP. For example, if in the case that the image transferred by the secondary transfer unit 45 may protrude from recording medium 906, the separating mechanism 46 of the image forming unit 90 is separated the secondary transfer backup roller 35 and the secondary transfer roller 44 from each other based on driving power transmitted from the separating motor 58. Hence, the desired image in accordance with the print data DP may be formed to the recording medium 906, or the image may be formed only on a part of the recording medium 906. Further, the image forming apparatus 3 ejects the recording medium 906.

Further, for example, the user can easily remove the recording medium 905 remaining the medium feeding unit 80 by opening the cover of the image forming apparatus 3.

Figure 16:
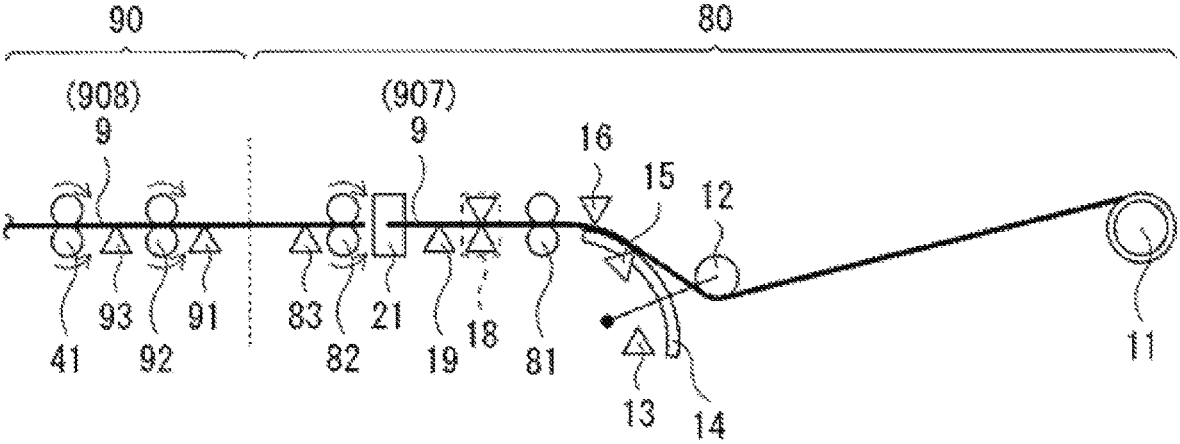
FIG. 16 is an explanatory diagram illustrating an example operation performed by the image forming apparatus illustrated FIG. 10.

FIG. 16 illustrates a case that the lock sensor 13 detects that the guide bar 12 is unlocked, and illustrates the operation state of the image forming apparatus 3 in a case where the recording medium 9 is cut. In this example, the trailing edge of the recording medium 9 is fixed to the core 110 as illustrated in FIG. 4A. In image forming apparatus 3, since the lock sensor 13 detects that the guide bar 12 is unlocked ("Y" in step S102) in step S102 of FIG. 12, the recording medium 9 is not the label sheet ("N" in step S104), and the recording medium 9 is conveyed the predetermined distance or more since the last cutting of the recording medium 9 ("Y" in step S302), the cutting unit 21 cuts the recording medium 9 (step S106 and step S107). Further, the motor controller 175 of the controller 170 is set to off state (blocked state) the clutch 152 (step S303). Hence, the medium feeding roller 82 of the medium feeding unit 80 stops the conveyance of the recording medium 9 (recording medium 907 in FIG. 16). That time, the medium feeding roller 81 stops the conveyance of the recording medium 907 from the timing when the guide bar 12 is unlocked until the recording medium 907 is conveyed by only the extra length (path length L1-path length L2). Hence, in the image forming apparatus 3, it is possible to reduce the risk of damage to the medium feeding unit 80 or various rollers or the like.

Meanwhile, in downstream of the cutting unit 21, the conveyance roller 82 of the medium feeding unit 80 and the conveyance roller 92 and the conveyance roller 41 of the image forming unit 90 continue to convey the cut recording medium 9 (recording medium 908). The recording medium 908 is cut at this step S107, and the medium length of the recording medium 908 is shorter than the medium length instructed by the print data DP. Hence, the desired image in accordance with the print data DP may be formed to the recording medium 908, or the image may be formed only on a part of the recording medium 908. Further, the image forming apparatus 3 ejects the recording medium 908.

Further, for example, the user can easily remove the recording medium 907 remaining the medium feeding unit 80 by opening the cover of the image forming apparatus 3.

Hence, in the image forming apparatus 3, the medium feeding roller 81 and the conveyance roller 82 easily rotate by the user pulls out the recording medium 9 remaining the medium feeding unit 80 since the clutch 152 and the clutch 153 are set to off state (blocked state). Therefore, the user can easily pull out the recording medium 901 in either the conveyance direction F1 or the direction opposite to the conveyance direction F1. Hence, the user can easily remove the recording medium 901.

In addition, in the image forming apparatus 3, if the trailing edge of the recording medium 9 is fixed to the core 110 (FIG. 14 and FIG. 16), the medium feeding roller 81 and the conveyance roller 82 stop the conveyance of the recording medium 9 from the timing that the guide bar 12 is unlocked until the recording the recording medium 9 is conveyed by only the extra length (path length L1-path length L2). Hence, in the image forming apparatus 3, it is possible to reduce the risk of damage to the medium feeding unit 80 or various rollers or the like.

In addition, in the image forming apparatus 3, if the recording medium 9 is cut (FIG. 15 and FIG. 16), the desired image in accordance with the print data DP may be formed to the cut recording medium (recording medium 906 and recording medium 908) or the image may be formed only on a part of the recording medium (recording medium 906 or recording medium 908). Therefore, it is possible to efficiently utilize the recording medium 9.

As described above, according to the third embodiment, if the recording medium 9 is conveyed the predetermined distance or more since the last cutting of the recording medium 9, the recording medium 9 is cut. Hence, it is possible to reduce the risk that the cut recording medium is remained in the image forming apparatus.

In present third embodiment, the clutch 152 is set to off state (blocked state) after cutting the recording medium, and the clutch 153 is set to off state (blocked state) after the trailing edge of the recording medium passes through the conveyance roller 82. Hence, in upstream of the cutting unit, the conveyance of the recording medium can stop, and in downstream of the cutting unit, the recording medium can continue to convey.

In the third embodiment, the medium feeding roller 81 and the conveyance roller 82 easily rotate by the user pulls out the recording medium remaining the medium feeding unit since the clutch is set to off state (blocked state). Hence, the user easily can remove the recording medium.

In the third embodiment, if the trailing edge of the recording medium is fixed to the core, the conveyance roller 82 stops the conveyance of the recording medium from the timing that the guide bar is unlocked until the recording medium is conveyed by only the extra length. Hence, it is possible to reduce the risk of damage to the medium feeding unit or various rollers.

As illustrated in FIG. 12, in above embodiments, the clutch 152 and the clutch 153 are set to off state in step S301, but this is not limited thereto. Alternatively, for example, the clutch 152 and the clutch 153 may not be set to off state. In addition, the clutch 153 is set to off state in step S305, but this is not limited thereto. Alternatively, for example, the clutch 153 may not be off state.

In the above embodiment, the clutch 152 and the clutch 153 are provided, but this is not limited thereto. In below, the image forming apparatus 3B according to the present modification example will be described in detail. The image forming apparatus 3B includes the medium feeding unit 80B and the image forming unit 90.

Figure 17:
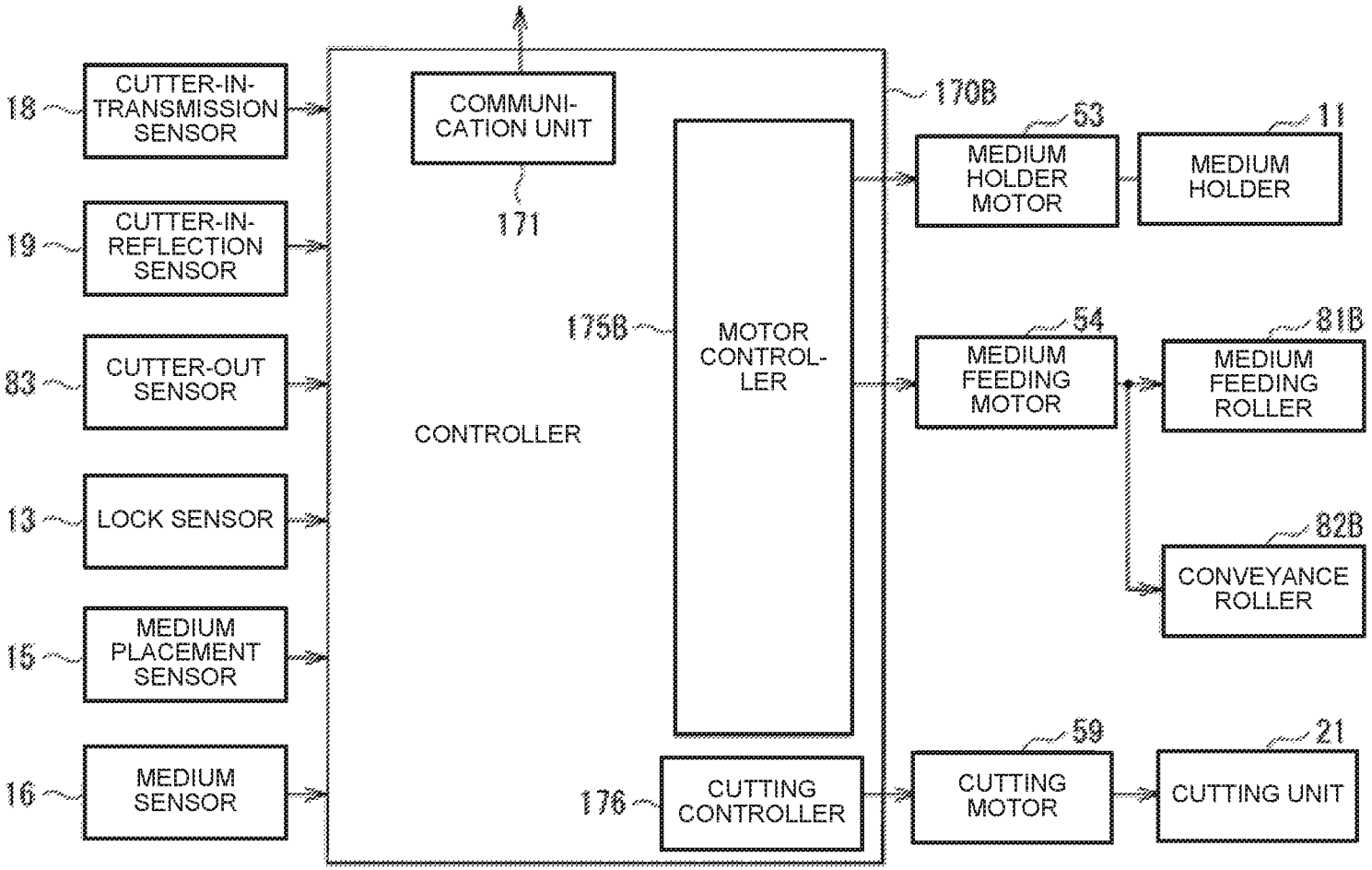
FIG. 17 is another block diagram illustrating an example configuration of a control mechanism of the image forming apparatus according to an embodiment.

FIG. 17 illustrates an example of a control mechanism in the medium feeding unit 80B. The image forming apparatus 3B includes a controller 170B, a medium feeding roller 81B, and a conveyance roller 82B.

The controller 170B controls the operation of the medium feeding unit 80B. In addition, the controller 170B has a function that communicates with the controller 160 that controls the operation of the image forming unit 90. The controller 170B includes a motor controller 175B. The motor controller 175B controls the operation of the medium holder motor 53 and the medium feeding motor 54.

The medium feeding roller 81B is a member including a pair of roller across the conveyance roller 8. The medium feeding roller 81B conveys the recording medium 9 along the conveyance path 8 based on driving power transmitted from the medium feeding motor 54. More specifically, in the image forming apparatus 3 according to the third embodiment, the medium feeding roller 81 is transmitted driving power via the clutch 152 from the medium feeding motor 54, but in the image forming apparatus 3B according to the present modification example, the medium feeding roller 81B is transmitted driving power without via the clutch 152 from the medium feeding motor 54.

The conveyance roller 82B is a one-way roller that includes a pair of roller across conveyance path 8. The conveyance roller 82B conveys the recording medium 9 along the conveyance path 8 based on the driving power transmitted from the medium feeding motor 54, and feeds the recording medium 9 to the medium forming unit 90. More specifically, in the image forming apparatus 3 according to the third embodiment, the conveyance roller 82 is transmitted driving power via the clutch 153 from the medium feeding motor 54, but in the image forming apparatus 3B according to the present modification example, the conveyance roller 82B is transmitted driving power without via the clutch 153 from the medium feeding motor 54.

Figure 18:
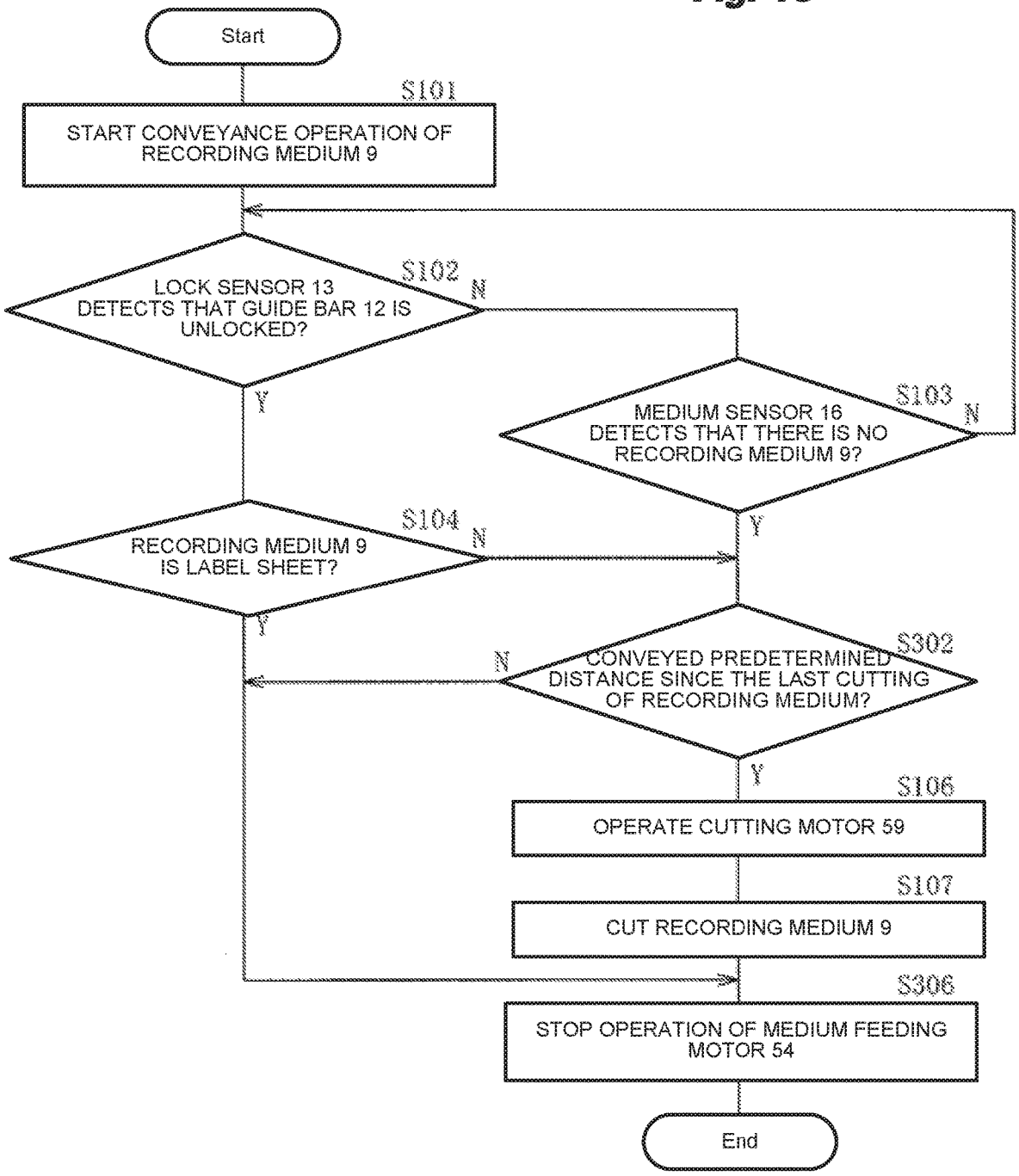
FIG. 18 is a flowchart illustrating an example operation performed by a control mechanism of the image forming apparatus according to an embodiment.

FIG. 18 illustrates an example operation performed by the image forming apparatus 3B.

For example, the image forming apparatus 3B starts the conveyance operation of the recording medium 9 by the communication unit 61 receiving the print data DP (step S101).

Next, the controller 170B confirms whether the lock sensor 13 detects that the guide bar 12 is unlocked (step S102). Further, if the lock sensor 13 dos not detect that the guide bar 12 is unlocked ("N" in step S102), the controller 170B confirms whether the medium sensor 16 detects that there is no recording medium 9 (step S103). If the medium sensor 16 does not detect that there is no recording medium 9 ("N" in step S103), the flow returns to step S102. Further, the step S102 and S103 repeat until the lock sensor 13 detects that the guide bar 12 is unlocked or the medium sensor 16 detects that there is no the recording medium 9.

In step S102, if the lock sensor 13 detects that the guide bar 12 is unlocked ("Y" in the step S102), the controller 170B confirms whether the recording medium 9 is the label sheet (step S104). If the recording medium 9 is the label sheet ("Y" in step S104), this flow proceeds to step S306.

In step S104, if the recording medium 9 is not the label sheet ("N" in step S104), or in step S103, or the medium sensor 16 detects that there is no recording medium 9 ("Y" in step S103), the controller 170B confirms whether the predetermined distance or more the recording medium 9 since the last cutting of the recording medium (step S302). If the recording medium 9 is not conveyed the predetermined distance or more ("N" in step S302), this flow proceeds to step S306.

In step S302, if the recording medium 9 is conveyed the predetermined distance or more ("Y" in step S302), the cutting controller 176 is operated the cutting motor 59 (step S106). Further, the cutting unit 21 cuts the recording medium 9 by rotating the blade of the cutter based on driving power transmitted from the cutting motor 59 (step S107). Hence, the medium length of the cut recording medium 9 has a length equal to or longer than the minimum conveyable medium length.

Further, the motor controller 175B is stopped the operation of the medium feeding motor 54 (step S306).

In this case, the medium feeding roller 81B and the conveyance roller 82B rotates by the user pulls out the recording medium 9 remaining the medium feeding unit 80B since the medium feeding motor 54 stops. Hence, the user can remove the recording medium 9. Especially, the user can easily pull out the recording medium 9 remaining the medium feeding unit 80B in the opposite direction of the conveyance direction F1 since the conveyance roller 82B makes up by using the one-way roller. Hence, the user can easily remove the recording medium 9.

In addition, in the image forming apparatus 3B, unlike the image forming apparatus 3, it is possible to reduce the number of components since the clutch 152 and the clutch 153 can be omitted.

The technology has been described above referring to the example embodiments and the modification examples thereof. However, the technology is not limited to the embodiments and the modification examples described above, and is modifiable in various ways.

For example, in the above embodiments and the above modification examples, the image is formed on the recording medium 9 by the electrophotographic method, but this is not limited thereto, and the image may be formed by any method. In addition, in above embodiments, a color image is formed on the recording medium 9, but this is not limited thereto, and a monochrome image may be formed.

For example, in the above embodiments and the above modification example, the toner image forming the developing unit 31 is transferred to the transfer belt 32 once, and the toner image transferred to the transfer belt 32 is transferred to the recording medium 9, but this is not limited thereto. Alternatively, for example, the toner image forming the developing unit may be directly transferred to the recording medium 9.

The invention claimed is:

1. An image forming apparatus comprising:

a medium holding unit that holds a recording medium;

a guide member configured to be movable between a first position and a second position, and that changes a direction and a length of a medium path, through which the recording medium fed from the medium holding unit is conveyed, in accordance with a position thereof;

a first sensor that detects the position of the guide member;

a first conveyance member that is arranged downstream of the guide member in the medium path, and that conveys the recording medium;

an image forming unit that forms an image to the recording medium conveyed by the first conveyance member; and a cutting unit that is arranged downstream of the first conveyance member and upstream of the image forming unit in the medium path, and that cuts the recording medium based on a detection result in the first sensor, wherein a length from the medium holding unit to the first conveyance member in the medium path when the guide member is at the first position is defined as L1, wherein a length from the medium holding unit to the first conveyance member in the medium path when the guide member is at the second position is defined as L2, wherein a distance that the recording medium is conveyed from a timing that the first sensor detects that the guide member moves from the first position to a timing that the cutting unit cuts the recording medium is defined as D1, and wherein the distance satisfies expression (A);

$$D1 < L1 - L2 \quad \text{(A)}.$$

2. The image forming apparatus according to claim 1, wherein the cutting unit cuts the recording medium, in a medium part of a predetermined length of the recording medium conveyed after the first sensor detects that the guide bar has moved from the first position.

3. The image forming apparatus according to claim 1, further comprising:

a second sensor that is arranged upstream of the cutting unit in the medium path, and detects presence of the recording medium, wherein the cutting unit cuts the recording medium based on a detection result in the second sensor in addition to the detection result in the first sensor.

4. The image forming apparatus according to claim 1, wherein the cutting unit cuts the recording medium in accordance with a type of the recording medium.

5. The image forming apparatus according to claim 1, further comprising a third sensor that is arranged upstream of the cutting unit in the medium path, wherein the recording medium includes a plurality of parallel labels, wherein the third sensor detects a position of the plurality of parallel labels, and wherein if the third sensor detects a gap between two adjacent labels among the plurality of parallel labels, in a medium part of a predetermined length of the recording medium conveyed after the first sensor detects that the guide bar has moved from the first position, the cutting unit cuts the recording medium at a position corresponding to the gap.

6. The image forming apparatus according to claim 1, wherein the cutting unit is configured to cut the recording medium when the recording medium has been conveyed by a distance longer than a predetermined distance since a last cutting of the recording medium.

7. The image forming apparatus according to claim 1, wherein the image forming unit includes a second conveyance member that conveys the recording medium, and wherein the second conveyance member continues to convey the recording medium after the cutting unit cuts the recording medium.

8. The image forming apparatus according to claim 1, further comprising a third conveyance member that is arranged downstream of the cutting unit in the medium path and upstream of the image forming unit in the medium path, and conveys the recording medium;

a driving motor that drives the third conveyance member; and a transmission unit that selectively transmits or blocks a driving power fed from the driving motor to the third conveyance member.

9. The image forming apparatus according to claim 1, further comprising a third conveyance member that is arranged downstream of the cutting unit in the medium path and upstream of the image forming unit in the medium path, and conveys the recording medium; and wherein the third conveyance member is configured by using a one-way roller.

10. The image forming apparatus according to claim 1, wherein the first conveyance member is configured to stop conveying the recording member after the cutting unit cuts the recording medium.

11. The image forming apparatus according to claim 1, wherein the first conveyance member is configured to stop conveying the recording medium, before a medium part of a predetermined length of the recording medium has been conveyed after the first sensor detects that the guide bar has moved from the first position.

12. The image forming apparatus according to claim 1, wherein the guide member is configured such that the movement of the guide member from the first position is caused when tension of the recording medium being conveyed exceeds a predetermined level.

* * * * *